US010845150B1

(12) United States Patent
Oglesby

(10) Patent No.: US 10,845,150 B1
(45) Date of Patent: Nov. 24, 2020

(54) FLASH SUPPRESSOR

(71) Applicant: Paul A. Oglesby, Darley (GB)

(72) Inventor: Paul A. Oglesby, Darley (GB)

( * ) Notice: Subject to any disclaimer, the term of this patent is extended or adjusted under 35 U.S.C. 154(b) by 0 days.

(21) Appl. No.: 16/252,657

(22) Filed: Jan. 20, 2019

Related U.S. Application Data

(63) Continuation-in-part of application No. 15/347,503, filed on Nov. 9, 2016, now Pat. No. 10,234,230.

(60) Provisional application No. 62/252,731, filed on Nov. 9, 2015.

(51) Int. Cl.
*F41A 21/34* (2006.01)

(52) U.S. Cl.
CPC ..... *F41A 21/34* (2013.01)

(58) Field of Classification Search
CPC ..... F41A 21/34; F41A 21/325
USPC .... 89/14.2, 14.05, 14.1, 14.3, 14.4; 42/1.06; 181/223
See application file for complete search history.

(56) References Cited

U.S. PATENT DOCUMENTS

| | | | | |
|---|---|---|---|---|
| 4,879,942 | A * | 11/1989 | Cave | F41A 21/36 89/14.3 |
| 5,092,223 | A * | 3/1992 | Hudson | F41A 21/38 89/14.2 |
| 8,104,394 | B2 * | 1/2012 | Meyers | F41A 21/34 89/14.2 |
| 9,228,789 | B1 * | 1/2016 | Oglesby | F41A 21/36 |
| 9,593,900 | B2 * | 3/2017 | Vossler | F41A 21/36 |
| 2015/0308774 | A1 * | 10/2015 | Sherrill | F41A 21/36 89/14.2 |
| 2016/0209153 | A1 | 7/2016 | Dueck et al. | |
| 2017/0191782 | A1 * | 7/2017 | Bray | F41A 21/36 |

* cited by examiner

*Primary Examiner* — John Cooper
(74) *Attorney, Agent, or Firm* — Shaddock Law Group, PC

(57) ABSTRACT

A muzzle device assembly, including a flash suppressor, wherein the flash suppressor comprises a body having a central bore aperture, and wherein the flash suppressor comprises a plurality of air channel inlets and air channels, wherein the air channel inlets and air channels are in fluid communication with the central bore aperture; and a collar, wherein the collar comprises a plurality of airflow apertures, wherein each airflow aperture corresponds to an air channel inlet, and wherein the collar is rotatable between at least an open position and a closed position relative to the flash suppressor, wherein when the collar is in the open position at least a portion of each airflow aperture is aligned with each air channel inlet.

15 Claims, 21 Drawing Sheets

FLASH SUPPRESSOR

CROSS-REFERENCE TO RELATED APPLICATIONS

This patent application is a Continuation-In-Part of U.S. patent application Ser. No. 15/347,503, filed Nov. 9, 2016, which claims the benefit of U.S. Patent Application Ser. No. 62/252,731, filed Nov. 9, 2015, the disclosures of which are incorporated herein in their entireties by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, the applicant owns all trademarks and service marks identified herein.

BACKGROUND OF THE INVENTION

1. Field of the Disclosure

The present disclosure relates generally to the field of firearms. More specifically, the present disclosure relates to an enhanced muzzle device or assembly or a flash suppressor and a flash suppressor assembly for firearms.

2. Description of Related Art

A flash suppressor, flash guard, flash eliminator, or flash hider is a device that is attached to the second end of a muzzle of a firearm that reduces the visible flash signature of the firearm, when it is fired, by dispersing or cooling the burning propellant gases, as they exit the muzzle of the firearm. The flash suppressor reduces the chances that the individual shooting the firearm will be temporarily blinded in lowlight shooting conditions and/or reduce the degree of muzzle flash visible to others.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

The known or current flash suppressor geometry and arrangement has various shortcomings. For example, known flash suppressors do not allow for sufficient propellant gas to be cooled or disbursed prior to exiting the muzzle end of the firearm. Because of this, known flash suppressors do not produce an effective amount of muzzle flash reduction.

Additionally, known flash suppressors also fail to add a sufficient amount of surface area to the second end of the firearm barrel.

Thus, the features and elements of the presently disclosed flash suppressors provide various flash suppressors features and design elements that overcome the shortcomings of known flash suppressors and provide improved, enhanced flash suppressors.

In various exemplary, non-limiting embodiments, the flash suppressor assembly of the present disclosure includes a flash suppressor, wherein the flash suppressor comprises a body having a central bore aperture, and wherein the flash suppressor comprises a plurality of air channel inlets and air channels, wherein the air channel inlets and air channels are in fluid communication with the central bore aperture; and a collar, wherein the collar comprises a plurality of airflow apertures, wherein each airflow aperture corresponds to and air channel inlets, and wherein the collar is rotatable between at least an open position and a closed position relative to the flash suppressor, wherein when the collar is in the open position at least a portion of each airflow aperture is aligned with each air channel inlet.

In various exemplary, nonlimiting embodiments, a base is included, which allows the collar to be spring-biased between the open in the closed positions.

In various exemplary, nonlimiting embodiments, the muzzle device of the present disclosure comprises a flash suppressor, wherein the flash suppressor comprises a body having a central bore aperture, and wherein the flash suppressor comprises a plurality of air channel inlets and air channels, wherein the air channel inlets and air channels are in fluid communication with the central bore aperture; and a collar, wherein the collar comprises a plurality of airflow apertures, wherein each airflow aperture corresponds to an air channel inlet, and wherein the collar is rotatable between at least an open position and a closed position relative to the flash suppressor, wherein when the collar is in the open position at least a portion of each airflow aperture is aligned with each air channel inlet.

In various exemplary, nonlimiting embodiments, the muzzle device of the present disclosure comprises a body portion extending from an attachment portion to a suppressor portion; a central borehole extending through the body portion; an internally threaded attachment recess extending from a first end of the body portion, along the central borehole; one or more air channel inlets formed proximate the first end; one or more longitudinally extending air channels, wherein each longitudinally extending air channel extends from an air channel inlet, through the internally threaded attachment recess, to the suppressor portion; one or more longitudinally extending slots defining side walls of elongate prongs; and a plurality of spaced apart relief cuts formed between an outer surface of the body portion and the side wall of each prong.

In various exemplary, nonlimiting embodiments, the muzzle device of the present disclosure comprises a flash suppressor, wherein the flash suppressor comprises a body having a central bore aperture, wherein the flash suppressor comprises a plurality of prongs defined between a plurality of slots, and wherein a plurality of relief cuts are disposed or formed between an outer surface of the body and side walls of each prong.

Accordingly, the present disclosure provides a flash suppressor with improved muzzle flash reduction.

The present disclosure separately provides a flash suppressor that provides improved cooling, burning, and/or disbursement of propelling gases exiting the muzzle end of a firearm.

The present disclosure separately provides a flash suppressor that has increased surface area.

The present disclosure separately provides a flash suppressor that can be retrofitted to an existing firearm.

The present disclosure separately provides a flash suppressor that can be easily installed by a user.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures. While features of the present disclosure may be discussed relative to certain embodiments and figures, all embodiments of the present disclosure can include one or more of the features discussed herein.

Further, while one or more embodiments may be discussed as having certain advantageous features, one or more of such features may also be used with the various embodiments discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, certain exemplary embodiments of the present disclosure are disclosed herein. However, it is to be understood that the disclosed embodiments are merely exemplary of the disclosure that may be embodied in various and alternative forms. The figures are not necessarily to scale and some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the present disclosure will be described in detail, with reference to the following figures, wherein like reference numerals refer to like parts throughout the several views, and wherein.

DETAILED DESCRIPTION OF THE INVENTION

For simplicity and clarification, the design factors and operating principles of the flash suppressor according to the present disclosure are explained with reference to various exemplary embodiments of a flash suppressor according to the present disclosure. The basic explanation of the design factors and operating principles of the flash suppressor is applicable for the understanding, design, and operation of the flash suppressor of the present disclosure. It should be appreciated that the flash suppressor can be adapted to many applications where a flash suppressor can be used.

It should also be appreciated that the terms "firearm" and "flash suppressor" are used for basic explanation and understanding of the operation of the systems, methods, and apparatuses of the present disclosure. Therefore, the terms "firearm" and "flash suppressor" are not to be construed as limiting the systems, methods, and apparatuses of the present disclosure.

For simplicity and clarification, the flash suppressor of the present disclosure will be described as being used in connection with a rifle. However, it should be appreciated that these are merely exemplary embodiments of the flash suppressor and are not to be construed as limiting the present disclosure. Thus, the flash suppressors of the present disclosure may be utilized in connection with any rifle, pistol, firearm, artillery piece, or other device.

Throughout this application the word "comprise", or variations such as "comprises" or "comprising" are used. It will be understood that these terms are meant to imply the inclusion of a stated element, integer, step, or group of elements, integers, or steps, but not the exclusion of any other element, integer, step, or group of elements, integers, or steps.

Figure 1:
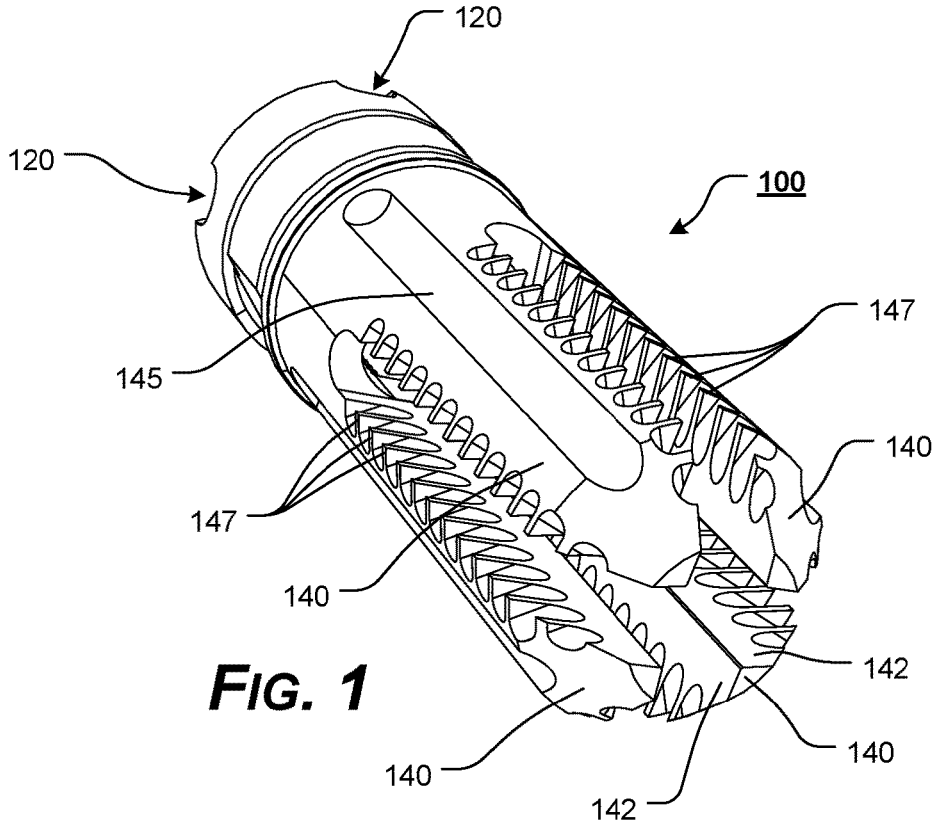
FIG. 1 shows a front perspective view of an exemplary embodiment of a muzzle device, according to the present disclosure.
Figure 2:
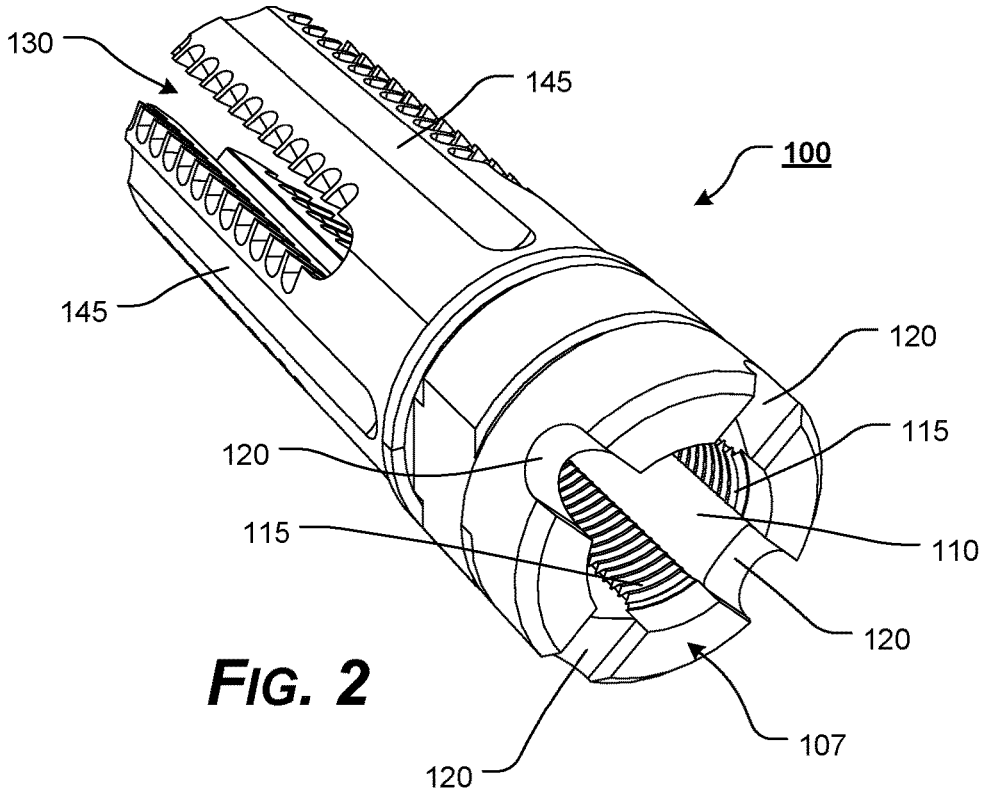
FIG. 2 shows a rear perspective view of an exemplary embodiment of a muzzle device, according to the present disclosure.
Figure 3:
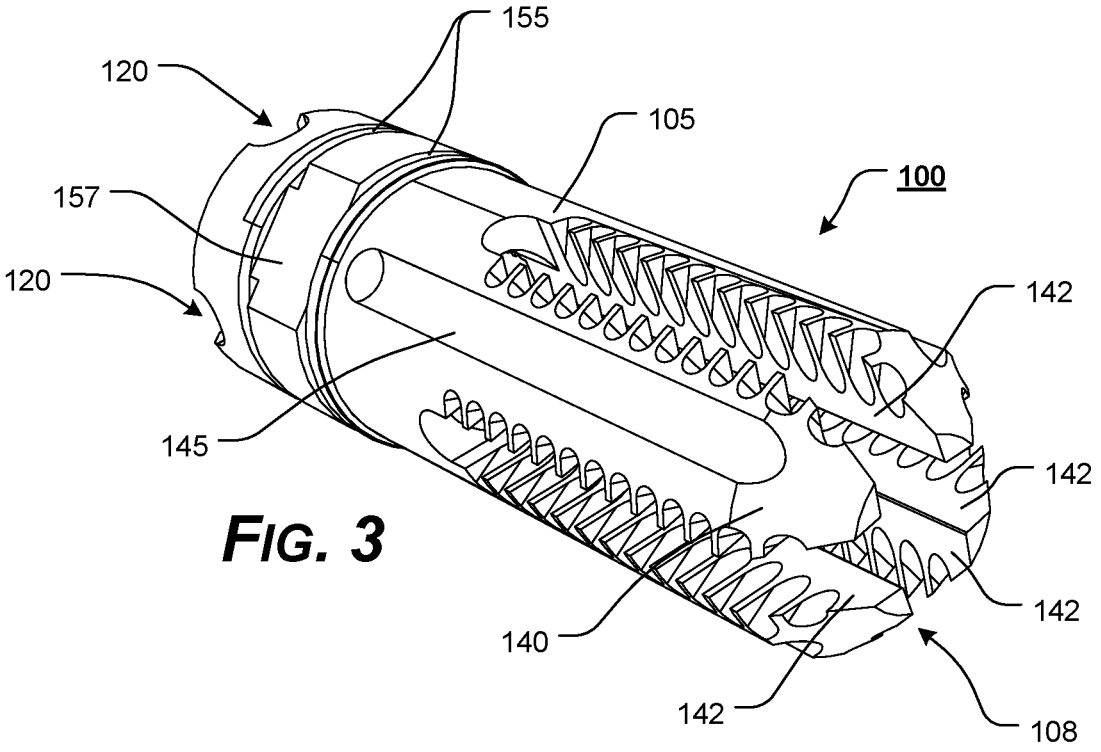
FIG. 3 shows a front perspective view of an exemplary embodiment of a muzzle device, according to the present disclosure.
Figure 4:
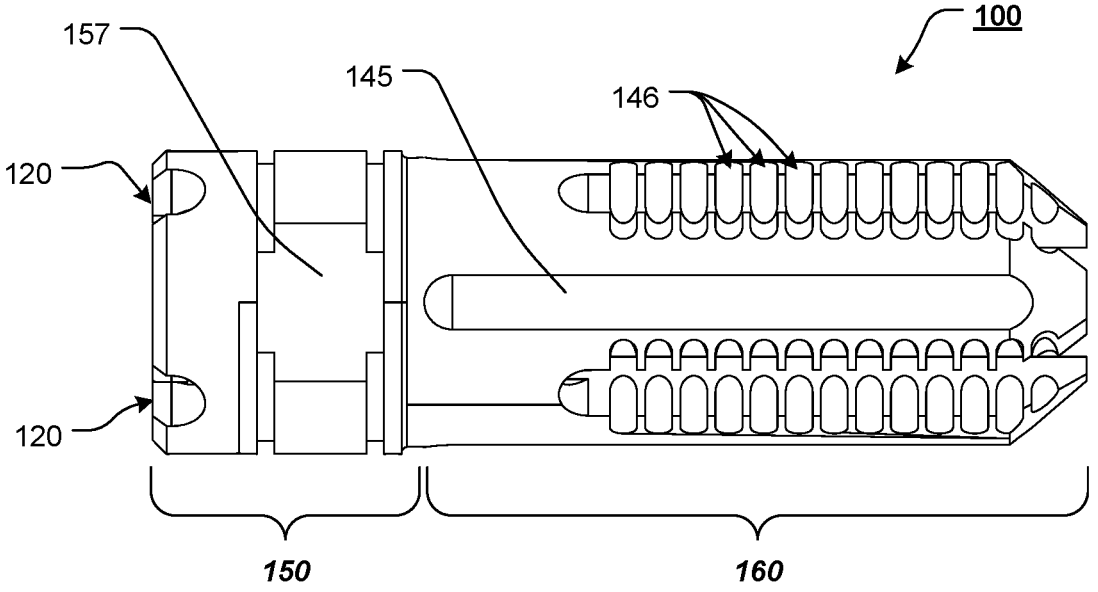
FIG. 4 shows a side view of an exemplary embodiment of a muzzle device, according to the present disclosure.
Figure 5:
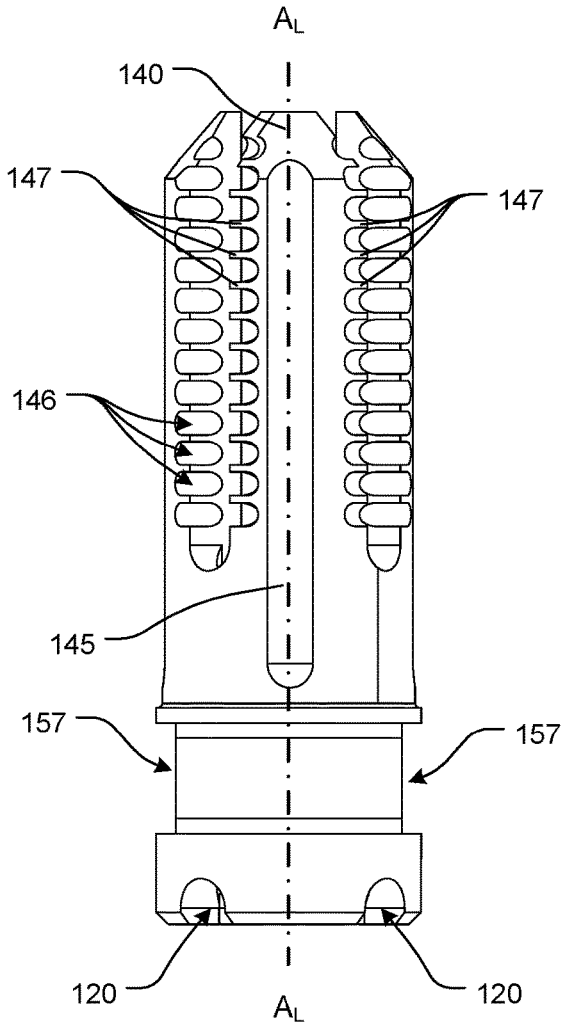
FIG. 5 shows a side view of an exemplary embodiment of a muzzle device, according to the present disclosure.
Figure 6:
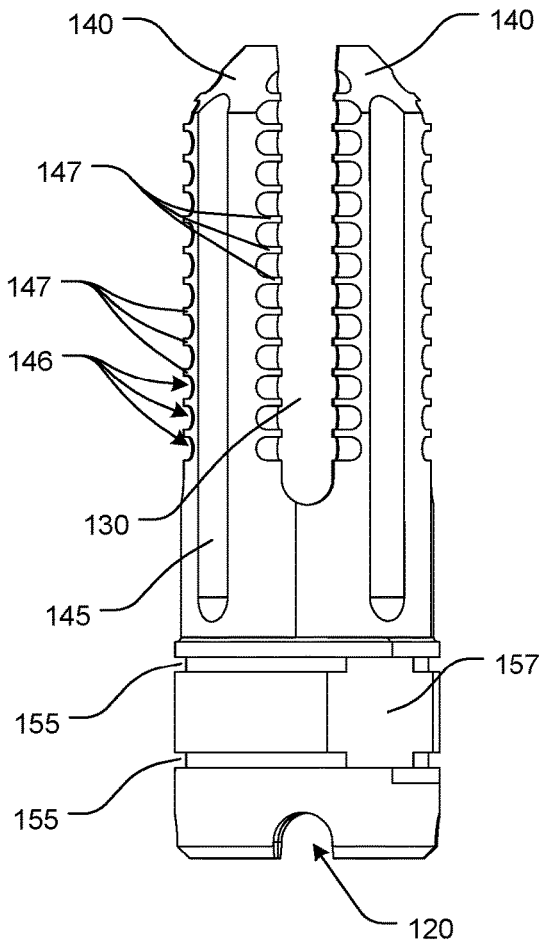
FIG. 6 shows a side view of an exemplary embodiment of a muzzle device, according to the present disclosure.
Figure 7:
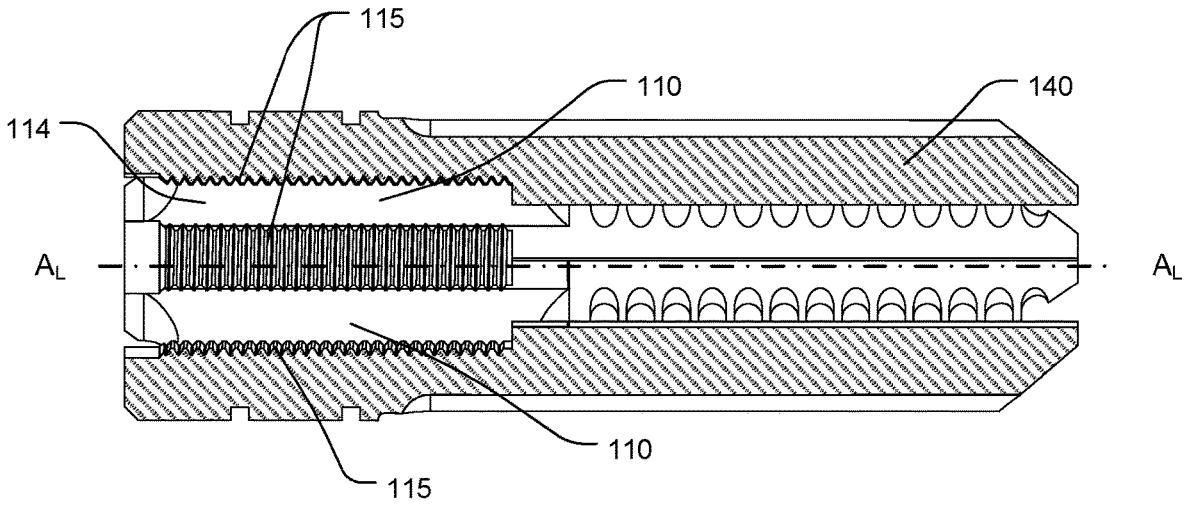
FIG. 7 shows a side cross-sectional view taken along line 7-7 of the muzzle device of FIG. 9.
Figure 8:
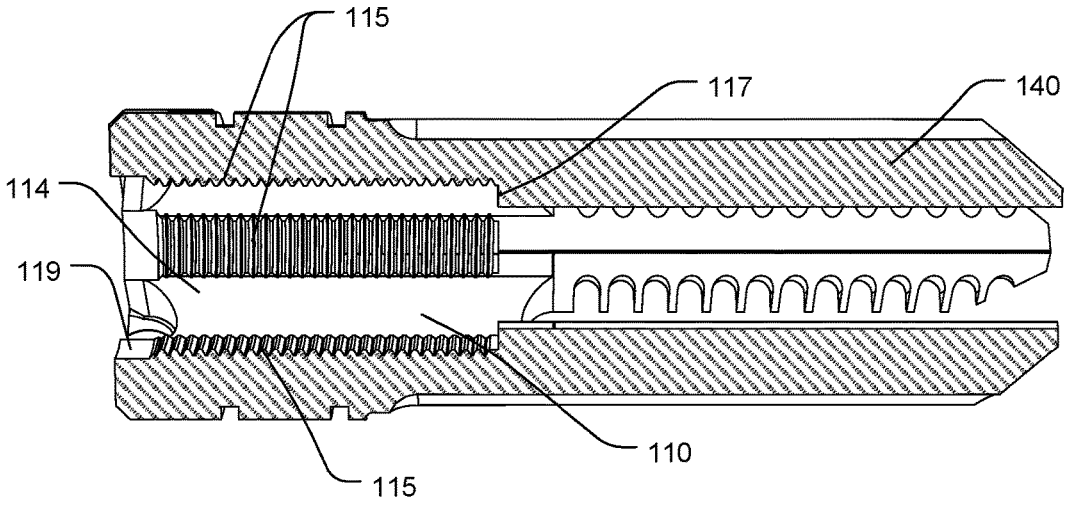
FIG. 8 shows a side cross-sectional view taken along line 7-7 of the muzzle device of FIG. 9.
Figure 9:
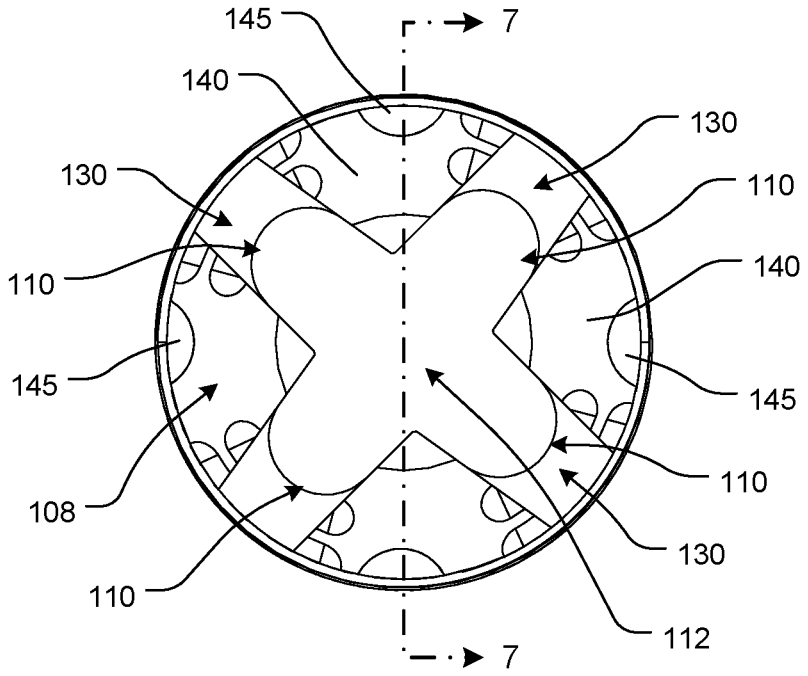
FIG. 9 shows a front view of an exemplary embodiment of a muzzle device, according to the present disclosure.
Figure 10:
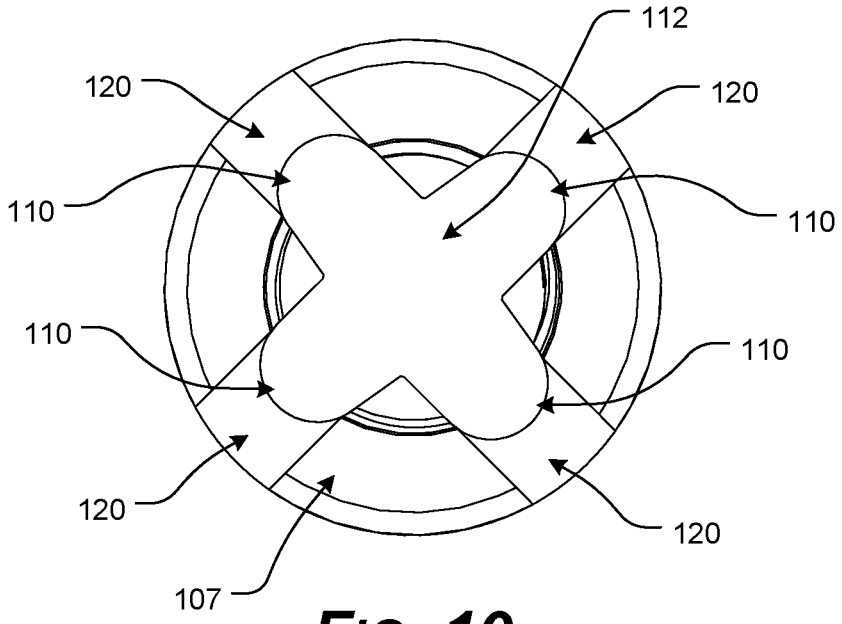
FIG. 10 shows a rear view of an exemplary embodiment of a muzzle device, according to the present disclosure.

Turning now to the drawing FIGS., FIGS. 1-10 illustrate certain elements and/or aspects of an exemplary embodiment of a flash suppressor 100, according to the present disclosure. In certain illustrative, non-limiting embodiments of the present disclosure, as illustrated in FIGS. 1-10, the flash suppressor 100 comprises at least some of a flash suppressor body or body portion 105 that extends from an attachment portion 150 to a suppressor portion 160.

The body portion 105 comprises an elongate portion of substantially cylindrical material that extends along a longitudinal axis $A_L$ from a first end 107 to a second end 108. In certain exemplary embodiments, various components of the flash suppressor 100, including the body portion 105, are formed of steel. Alternate materials of construction of the various components of the body portion 105 may include one or more of the following: stainless steel, aluminum, titanium, and/or other metals, as well as various alloys, combinations, and/or composites thereof. Thus, it should be understood that the material or materials used to form the flash suppressor 100 is a design choice based on the desired appearance, strength, and functionality of the flash suppressor 100.

While the body is shown and described as being substantially cylindrical in shape, it is to be distinctly understood that the body may comprise any shape. Thus, while a substantially cylindrical outer shape would allow for ease in manufacturing and would conform with the customary use of cylindrical shaped muzzle brakes, the shape of the body portion 105 is not limited to being substantially cylindrical and, for example, may be substantially oval, oblong, triangular, square, rectangular hexagonal, octagonal, etc.

The flash suppressor 100 extends from an attachment portion 150 that is adapted to attach to a muzzle end of a firearm barrel (not shown) to a suppressor portion 160 that extends beyond the muzzle end of the firearm barrel, along a longitudinal axis $A_L$ of the body portion 105.

A central borehole 112 extends through the body portion 105, generally along the longitudinal axis $A_L$ of the body portion 105. The central borehole 112 has a central borehole 112 diameter $D_{CBA}$. Typically, the central borehole 112 diameter $D_{CBA}$ is sufficient to allow the caliber of round with which the flash suppressor 100 is to be utilized to safely pass through the central borehole 112. Thus, it should be appreciated that the diameter $D_{CBA}$ of the central borehole 112 is a design choice based upon the size of the projectile or caliber of weapon or other device with which the flash suppressor 100 is to be utilized.

An internally threaded attachment recess 114 extends along the central borehole 112 from the first end 107 to a recess shoulder 117. The internally threaded attachment recess 114 is adapted to receive at least a portion of a firearm barrel (not shown) and allow the flash suppressor 100 to be threadedly attached to the barrel. In various exemplary embodiments, the internally threaded attachment recess 114 has a thread size of 1/2-24, a common thread size for threaded muzzle devices utilized with 0.223 or 5.56 rifle barrels. However, it should be appreciated that the thread size of the internally threaded attachment recess 114 may be adapted to receive a portion of a barrel having any desired thread size. Thus, the thread size and/or pitch of the internally threaded attachment recess 114 is a design choice based upon the threaded barrel size of the weapon or other device with which the flash suppressor 100 is to be used. Additionally, it should be appreciated that the threads may be right-hand threads or left-hand threads.

In various exemplary embodiments, the internally threaded attachment recess 114 is initiated by a recessed portion 119. If included, the recessed portion 119, may also allow for improved ease of threading the flash suppressor 100 to a barrel.

One or more longitudinally extending air channels 110 are formed that extend, from an air channel inlet 120 proximate the first end 107, through the internally threaded attachment recess 114, to the suppressor portion 160 of the body portion 105. Each air channel 110 is offset from and separated from each adjacent air channel 110. Each air channel 110 extends through the internally threaded attachment recess 114 so as to interrupt the internal, interrupted mounting threads 115 of the internally threaded attachment recess 114 and define segments of interrupted mounting threads 115.

The air channels 110 extend, between the interrupted mounting threads 115, to the suppressor portion 160 and allow fluid communication between the air channels 110, the central borehole 112 of the suppressor portion 160, and the longitudinally extending slots 130 of the suppressor portion 160. Thus, the one or more air channels 110 are used to form internal channels that intersect the threads and allow fluid communication between internally threaded attachment recess 114 and the outside surface of the flash suppressor 100.

The air channel inlets 120 allow for fluid communication from the exterior of the flash suppressor 100, through the air channels 110, even if the first end 107 of the flash suppressor 100 is flush against a shoulder of a firearm muzzle or another surface. Thus, air is able to enter from the outer surface of the flash suppressor 100, through the air channel inlet 120, and travel along the air channel 110, through the suppressor portion 160 and exit through the central borehole 112 or one of the plurality of slots 130. In this manner, other elements, such as crush washers or timing shims, can still be used without obstructing the flow of air through the air channel inlets 120 and air channels 110.

The inclusion of the air channel inlets 120 and air channels 110 provides a Venturi-like effect to draw relatively cooler, outside or ambient air in, proximate the first end 107 of the flash suppressor 100, and mix the relatively cooler intake air with muzzle propellant gas. Thus, "extra" air from the exterior of the flash suppressor 100 can be mixed with the propellant gases as they flow through the central borehole 112 and the slots 130 to efficiently reduce muzzle flash signature.

The overall length, size, shape, and depth of each air channel inlet 120 and corresponding air channel 110 is a design choice based upon the desired functionality (i.e. fluid capacity, fluid flow characteristics, etc.) of the flash suppressor 100.

The flash suppressor 100 is shown as having the internally threaded attachment recess 114 to allow the flash suppressor 100 to be threadedly attached to the barrel of a firearm. In certain exemplary embodiments, the attachment portion 150 of the body may optionally be attached to the barrel by any suitable means, including, for example, clamps, quick-release connectors, or any other known or later developed attachment device. Thus, it should be understood that such attachment may also be accomplished by a coupling or any other means sufficient to attach or couple the flash suppressor 100 to the muzzle end of a firearm, including those typical in the prior art. In still other exemplary embodiments, the flash suppressor 100 (and the disclosed flash suppressor assembly 400) may be substantially permanently affixed to the muzzle of a firearm.

Even in embodiments wherein alternate attachment or coupling means are utilized, the air channel inlets 120 and corresponding air channels 110 may still be formed through the attachment portion 150 of the flash suppressor 100.

Thus, the attachment portion 150 of the body contains a means for attaching the flash suppressor 100 to a muzzle end of a firearm barrel, while the suppressor portion 160 of the body is adapted to discharge a projectile though the central borehole 112.

To aid in the installation of the flash suppressor 100, parallel flats 157 may be provided on either side of the body portion 105, proximate the first end 107. The flats 157 provide parallel surfaces for a wrench or other installation device to grip the flash suppressor 100.

One or more partially-circumferentially or circumferential attachment grooves 155 may be formed in the attachment portion 150 for securing additional devices (not shown) to the flash suppressor 100.

The suppressor portion 160 of the body includes longitudinally extending slots 130 that form or define side walls 142 of forwardly extending elongated members or prongs 140. Each prong 140 is offset from and separated from each adjacent prong 140 by the longitudinally extending slots 130. The apexes of adjacent side walls 142 are proximate to, and at least partially define, the central borehole 112. In various exemplary embodiments, a centerline of one or more of the slots 130 may optionally be offset from a bisecting centerline of the body portion 105.

In certain exemplary embodiments, the width of each slot 130 is at least partially tapered, such that each slot 130 is wider proximate the central borehole 112 and narrower proximate the outer surface. By tapering the width of each slot 130, when a projectile is discharged through the central borehole 112, propellant gases are forced outwards and forwards as the propellant gases are discharged through the central borehole 112, thereby dispersing the propellant gases radially away from the central borehole 112. This increases turbulence and mixing of more air with the propellant or blast gasses, thus reducing flash further.

In certain exemplary, nonlimiting embodiments, as illustrated herein, the suppressor portion 160 includes four slots 130 defining four prongs 140. However, it should be appreciated that the suppressor portion 160 may comprise a greater or lesser number of slots 130 and prongs 140. Thus, the number of slots 130 and prongs 140 is a design choice based upon the desired functionality and/or appearance of the flash suppressor 100.

In certain exemplary, nonlimiting embodiments, an external trough 145 is formed in at least a portion of an exterior of each prong 140. If included, the trough 145 may optionally extend at least partially along a length of the prong 140. The overall length, size, shape, and depth of each trough 145 is a design choice based upon the desired functionality (i.e. thermal capacity, volume, vibrational characteristics, etc.) and/or appearance of the flash suppressor 100.

A plurality of spaced apart relief cuts 146 are disposed or formed between the outer surface of the body portion 105 and the side wall 142 of each prong 140. In various exemplary embodiments, the plurality of relief cuts 146 extend through adjacent outer surfaces of the body portion 105 and inner edge or side wall surfaces of each prong 140. An extending tooth 147 is formed between adjacent relief cuts 146. Thus, a plurality of extending teeth 147 are formed along each prong 140.

In certain exemplary embodiments, the relief cuts 146 (and resulting teeth 147) are formed at uniformly spaced apart locations along at least a portion of each prong 140. In certain exemplary embodiments, the relief cuts 146 (and resulting teeth 147) are formed at non-uniformly spaced locations along at least a portion of each prong 140. In still other exemplary embodiments, the relief cuts 146 (and resulting teeth 147) are formed in a desired pattern or arrangement along at least a portion of each prong 140.

In various exemplary embodiments, the spacing and angle of the relief cuts 146 (angled away from the central borehole 112) increases the efficiency at which the relief cuts 146 disturb and mix the propellant gases passing over/through the surfaces of the relief cuts 146 and teeth 147.

In various exemplary embodiments, as illustrated herein, the relief cuts 146 may be formed of substantially radiused, angled recesses, having substantially parallel side walls 142. However, it should be appreciated that the relief cuts 146 may be formed of inwardly or outwardly tapered cuts, spiral or helical cuts, and/or textured cuts. Additionally, it should be appreciated that the overall size, shape, and angle of each relief cut 146 may be consistent throughout the relief cuts 146 or may vary throughout the relief cuts 146. Therefore, it should be appreciated that the relief cuts 146 may, but need not be uniformly dimensioned and may vary in size, shape, depth, width, angle, or any other design characteristic according to any desired or determined pattern or arrangement.

By providing relief cuts 146, the surface area of the flash suppressor body and prongs 140 is increased and constricted propellant gases are able to expand through the relief cuts 146 and increase the efficient disruption of the propellant gases as they move through the flash suppressor 100. As propellant gases move through the flash suppressor 100, the teeth 147 further disrupt the propellant gases as they flow across the uneven outer surface (as presented by the surfaces of the relief cuts 146 and teeth 147) rather than a substantially smooth central bore.

During use of the flash suppressor 100, as a round exits the muzzle of the firearm, it travels through the central borehole 112. The propellant gases propelling the round enter the central borehole 112 and, utilizing the Venturi effect, pull ambient, outside air through the air channel inlets 120 and the air channels 110 to mix with the propellant gases. As the propellant gases continue to move through the central borehole 112, a portion of the propellant gases flow through the slots 130 and expand into the plurality of relief cuts 146. Because of the increased surface area created by the relief cuts 146, the portion of the propellant gases flowing through the relief cuts 146 is further cooled as it travels outwardly, through the slots 130, and into the surrounding, ambient air. A remaining portion of the propellant gases then continues to flow outward from the central borehole 112 into the ambient air.

Figure 11:
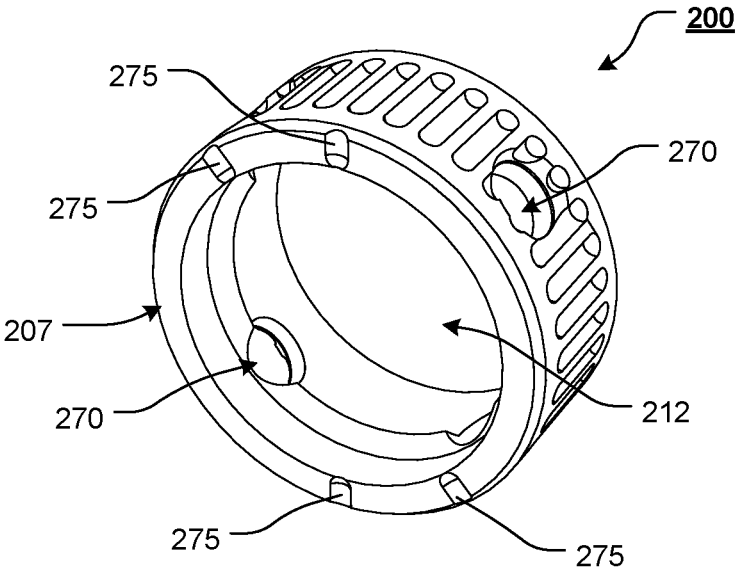
FIG. 11 shows a rear perspective view of an exemplary embodiment of a collar, according to the present disclosure.
Figure 12:
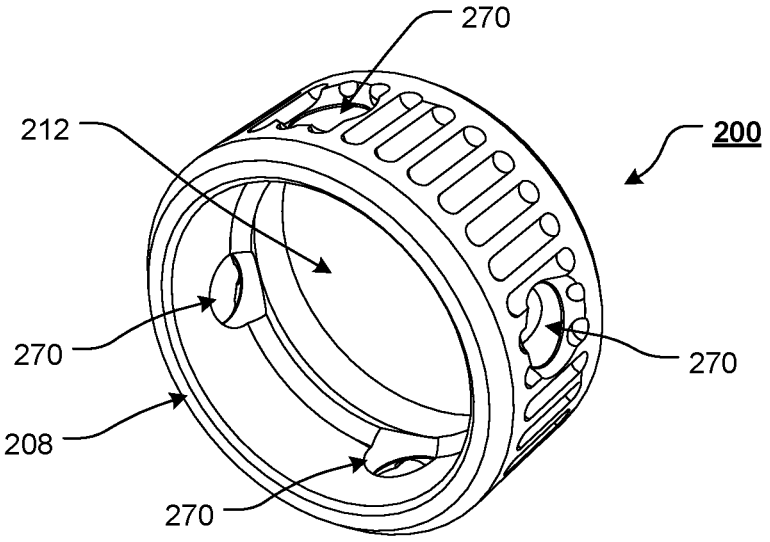
FIG. 12 shows a front perspective view of an exemplary embodiment of a collar, according to the present disclosure.
Figure 13:
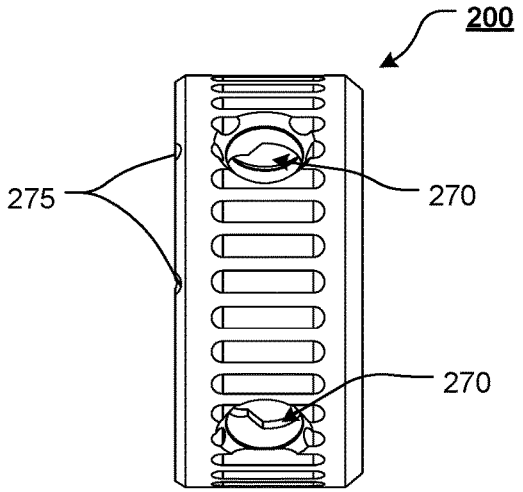
FIG. 13 shows a side view of an exemplary embodiment of a collar, according to the present disclosure.
Figure 14:
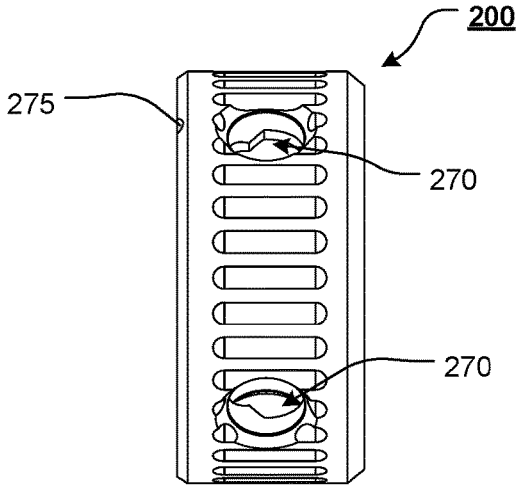
FIG. 14 shows a side view of an exemplary embodiment of a collar, according to the present disclosure.
Figure 15:
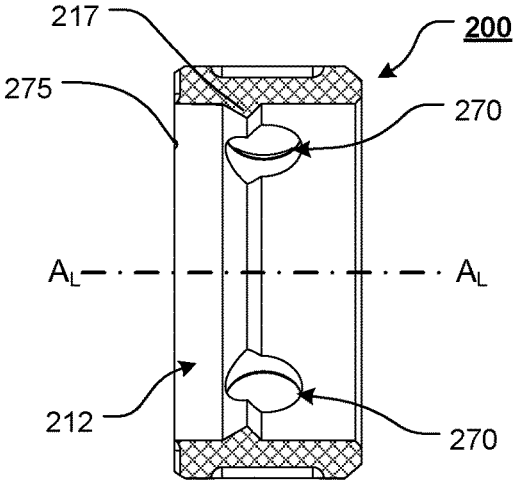
FIG. 15 shows a side cross-sectional view taken along line 15-15 of the collar of FIG. 16.
Figure 16:
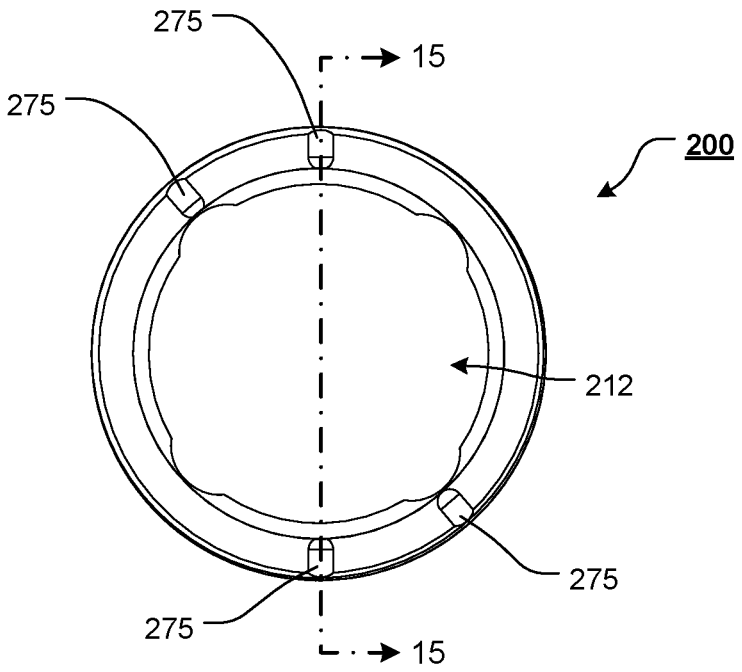
FIG. 16 shows a front view of an exemplary embodiment of a collar, according to the present disclosure.
Figure 17:
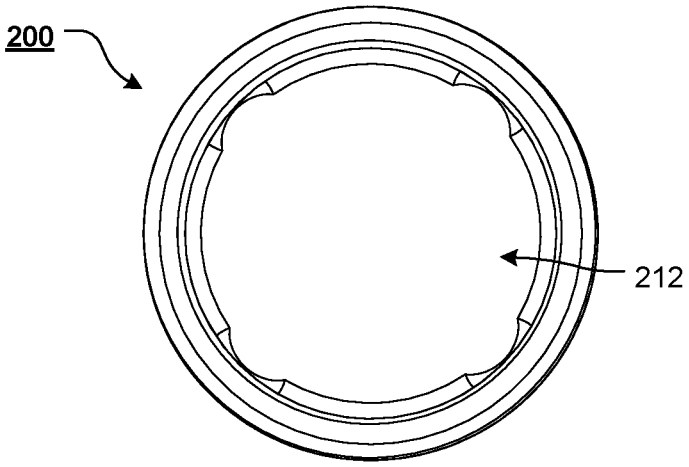
FIG. 17 shows a rear view of an exemplary embodiment of a collar, according to the present disclosure.
Figure 18:
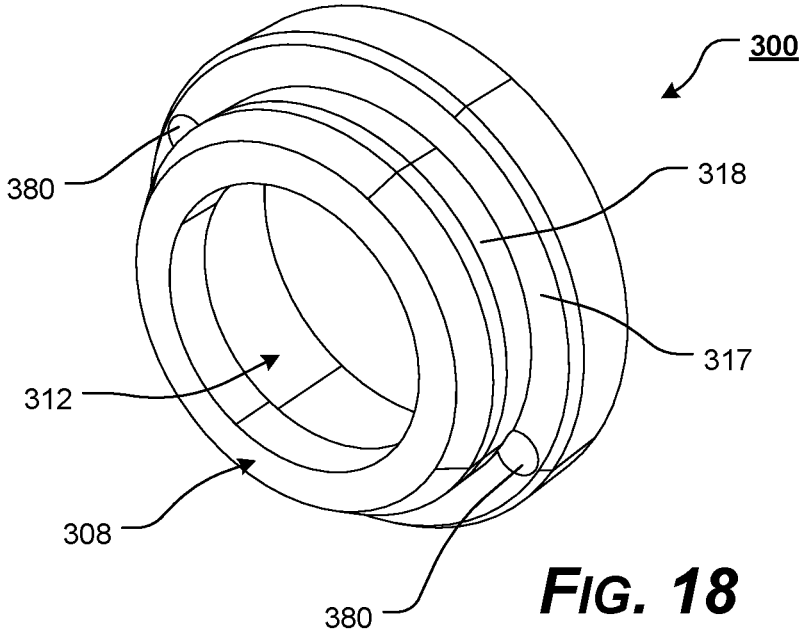
FIG. 18 shows a front perspective view of an exemplary embodiment of a collar base, according to the present disclosure.
Figure 19:
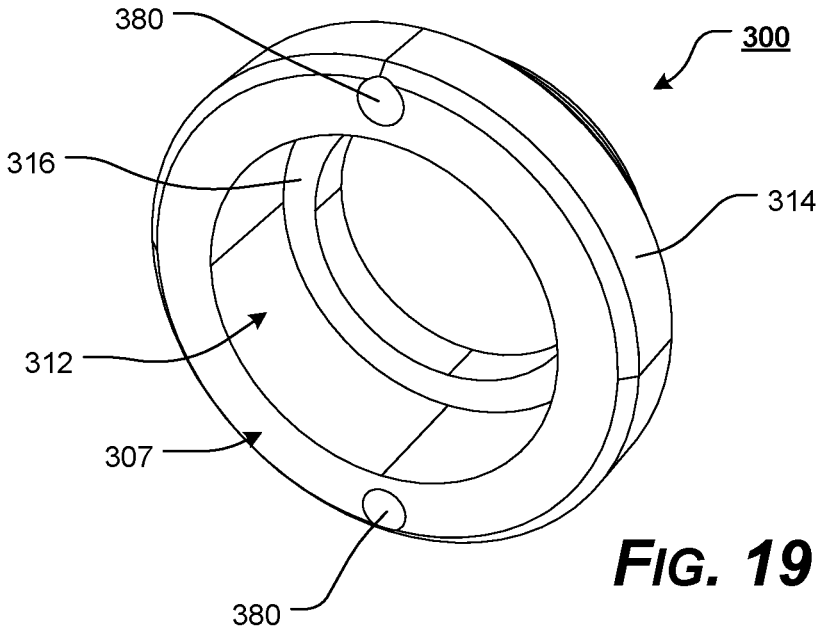
FIG. 19 shows a rear perspective view of an exemplary embodiment of a collar base, according to the present disclosure.
Figure 20:
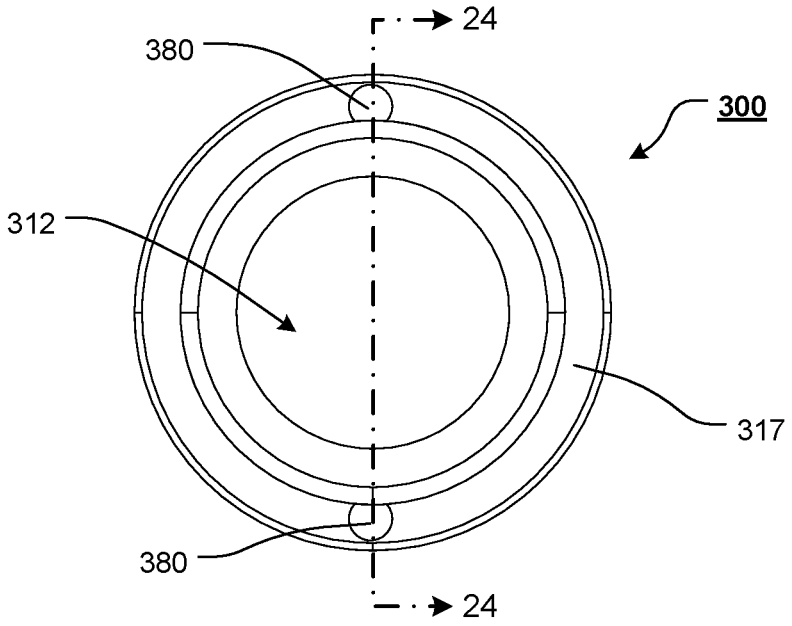
FIG. 20 shows a front view of an exemplary embodiment of a collar base, according to the present disclosure.
Figure 21:
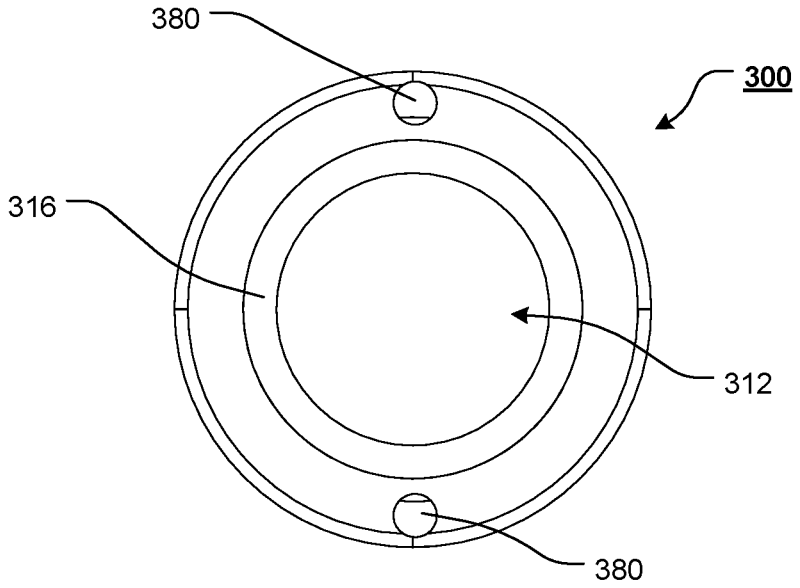
FIG. 21 shows a rear view of an exemplary embodiment of a collar base, according to the present disclosure.
Figure 22:
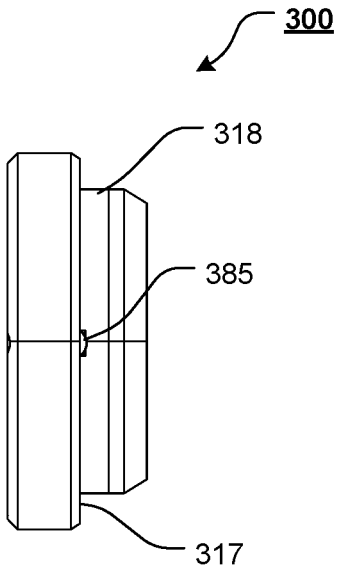
FIG. 22 shows a side view of an exemplary embodiment of a collar base, according to the present disclosure.
Figure 23:
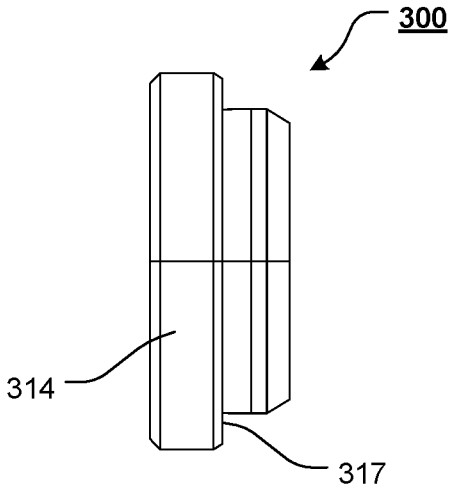
FIG. 23 shows a side view of an exemplary embodiment of a collar base, according to the present disclosure.
Figure 24:
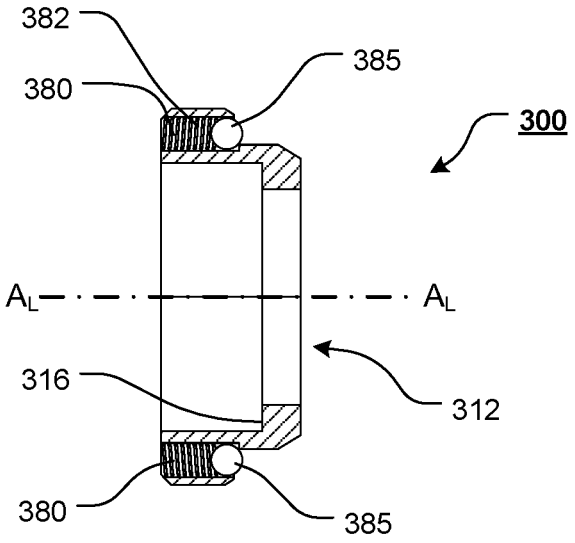
FIG. 24 shows a side cross-sectional view taken along line 24-24 of the collar base of FIG. 20.
Figure 25:
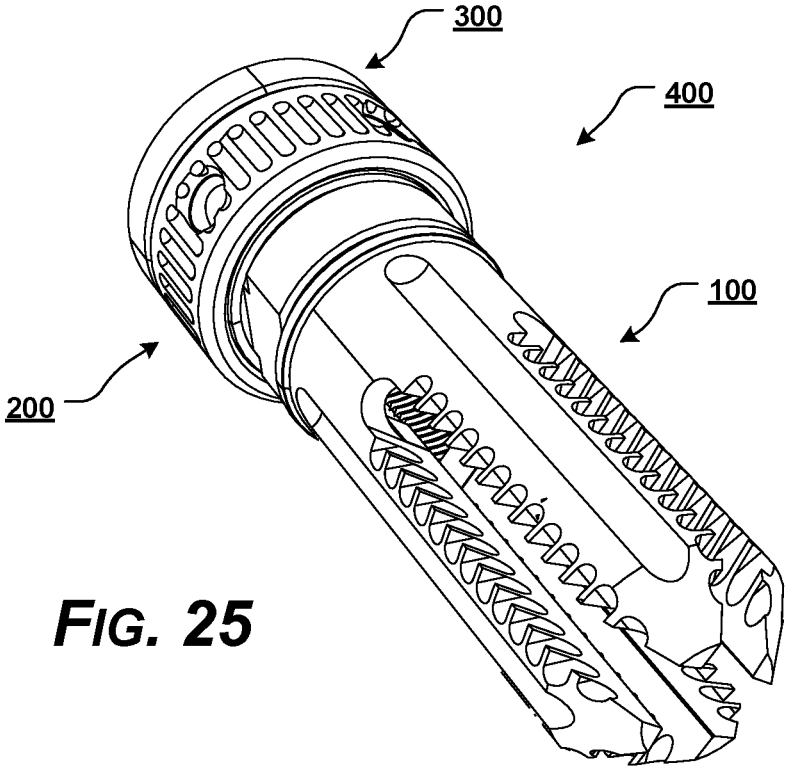
FIG. 25 shows a front perspective view of an exemplary embodiment of a flash suppressor assembly, according to the present disclosure.
Figure 26:
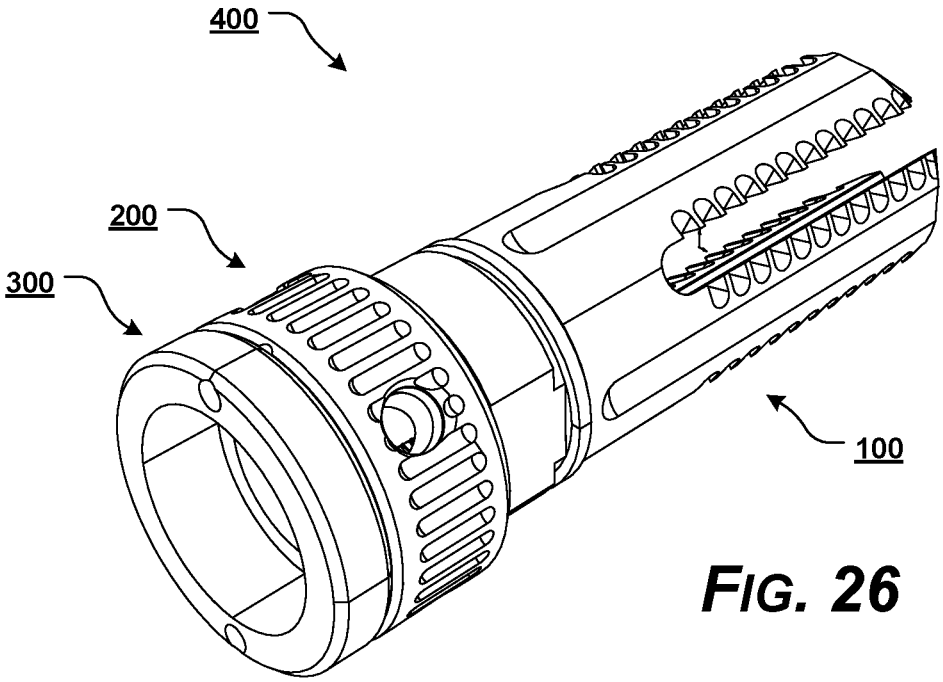
FIG. 26 shows a rear perspective view of an exemplary embodiment of a flash suppressor assembly, according to the present disclosure.
Figure 27:
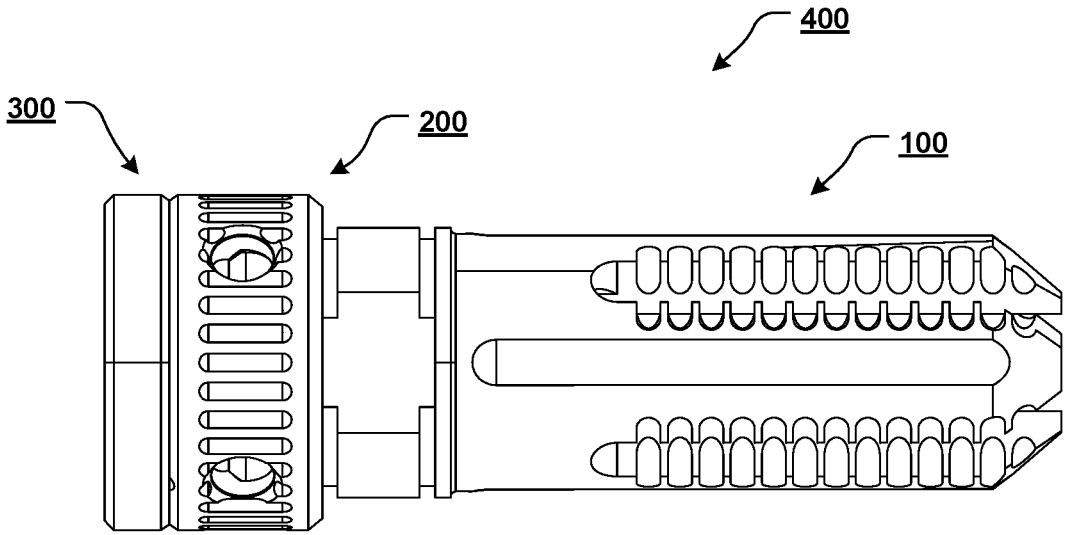
FIG. 27 shows a side view of an exemplary embodiment of a flash suppressor assembly, according to the present disclosure.
Figure 28:
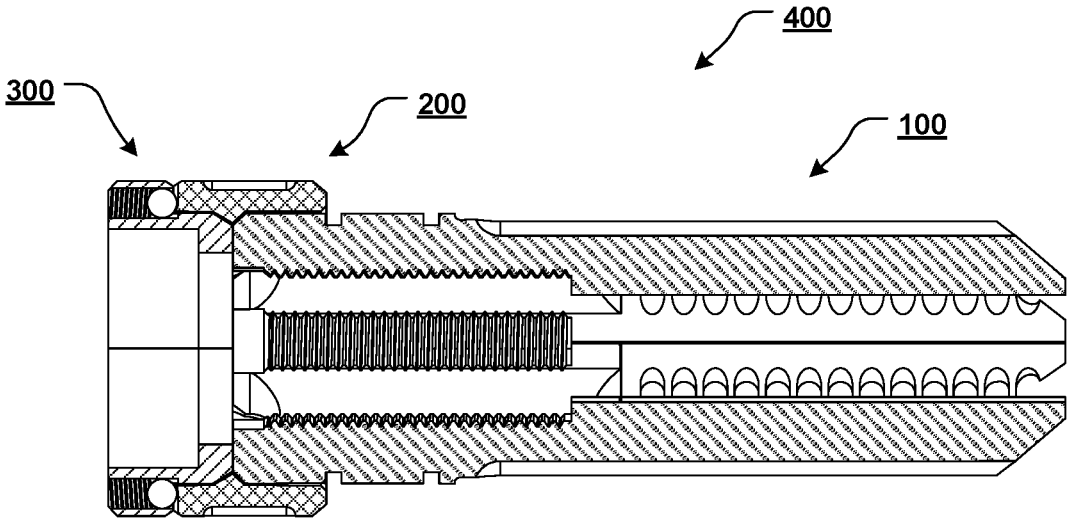
FIG. 28 shows a side cross-sectional view of the flash suppressor assembly of FIGS. 25-27.

FIGS. 11-17 illustrate certain elements and/or aspects of an exemplary embodiment of collar 200 that may optionally be used in conjunction with the flash suppressor 100. FIGS. 18-24 illustrate certain elements and/or aspects of an exemplary embodiment of collar base 300 that may optionally be used in conjunction with the collar 200 and flash suppressor 100. FIGS. 25-28 illustrate an exemplary embodiment of the collar 200 and collar base 300 being used in conjunction with the flash suppressor 100, as a flash suppressor assembly 400.

As illustrated in FIGS. 11-28, the collar 200 comprises a ring or tubular sleeve extending from a first end 207 to a second end 208. The collar 200 also comprises an outer surface and an inner surface, wherein the inner surface defines a central bore aperture 212 of the collar 200. The central bore aperture 212 of the collar 200 is formed so as to allow at least a portion of the attachment portion 150 of the flash suppressor 100 to be fitted within at least a portion of the central borehole aperture of the collar 200 and abutted against a shoulder or extension 217 of the inner surface of the collar 200. Once so assembled, the collar 200 is rotatable relative to the flash suppressor 100.

One or more airflow apertures 270 are formed through the collar 200, such that the central bore aperture 212 is in fluid communication with an exterior of the collar 200, via the one or more airflow apertures 270. The positioning of one or more of the airflow apertures 270 is such that the included airflow apertures 270 can be at least partially and optionally fully aligned with one or more corresponding air channel inlets 120 of the flash suppressor 100.

The collar base 300 comprises a portion of material extending, along a longitudinal axis $A_L$, from a first end 307 to a second end 308. In various exemplary embodiments, a base extension portion 318 extends rearward from the second end 308. The base extension portion 318 extends from the second end 308 to a base shoulder 317. In various exemplary embodiments, the base extension portion 318 extends parallel to the longitudinal axis $A_L$, of the collar base 300 and the base shoulder 317 extends perpendicular to the longitudinal axis $A_L$, of the collar base 300. Alternatively, the base shoulder 317 may extend at an angle that is equal to, greater than, or less than 90° relative to the longitudinal axis $A_L$, of the collar base 300.

The outer size and shape of the base extension portion 318 is such that at least a portion of the base extension portion 318 can be fitted within at least a portion of the central borehole of the collar 200 and abutted against a shoulder or extension 217 of the inner surface of the collar 200.

A base flange portion 314 extends from the base shoulder 317 to the second end 308. In various exemplary embodiments, the base flange portion 314 has a generally cylindrical overall shape.

In various exemplary embodiments, the base flange portion 314 has a larger outer diameter or size than an outer diameter or size of the base extension portion 318. Thus, the base shoulder 317 provides a transition between the base flange portion 314 and the base extension portion 318.

A central bore aperture 312 is formed through the collar base 300, along the longitudinal axis $A_L$, of the collar base 300. At least a portion of the central bore aperture 312, as defined between the first end 307 and a ledge 316 formed within the central bore aperture 312 of the collar base 300 is sized so as to allow at least a portion of a firearm muzzle to be received is therein, when the flash suppressor assembly 400 is attached or coupled to the barrel of the firearm or other device.

Ball detent apertures 380 are formed through at least a portion of the base flange portion 314 at determined, spaced apart locations. Spring-biased ball detents 385 are positioned within the ball detent apertures 380.

One or more registration notches 275 are formed in the first end 207 of the collar 200. The one or more registration notches 275 are each formed so as to be aligned with and interact with corresponding spring-biased ball detents 385 extending from ball detent apertures 380 formed in the collar base 300. Thus, when assembled to form the flash suppressor assembly 400, as illustrated in FIGS. 25-28, the interaction of the spring-biased ball detents 385 and the registration notches 275 allow the collar 200 to be rotated and locked in an open and a closed position.

When in the open position, the airflow apertures 270 of the collar 200 are aligned with the air channel inlets 120 of the flash suppressor 100, so as to allow substantially uninterrupted airflow through the air channel inlets 120. When in the closed position, the airflow apertures 270 of the collar 200 are rotated so as to be out of alignment with the air channel inlets 120 of the flash suppressor 100. In this position, the air channel inlets 120 are substantially sealed and the flow of ambient air into the air channel inlets 120 is fully or at least partially occluded or obstructed.

It should be appreciated that when the collar 200 is in an open or closed position, a rotational force can be applied to the collar 200, sufficient to overcome the spring biasing force of the spring biasing element(s) 382 on the ball detents 385, forcing the ball detents 385 out of the registration notches 275 and into the ball detent apertures 380 a sufficient distance so as to allow the collar 200 to be rotated in a desired direction. When a subsequent set of registration notches 275 is aligned with the detents, the spring biasing force of the spring biasing element(s) 382 urges the ball detents 385 into the registration notches 275, maintaining the collar 200 in a determined rotational position relative to the collar base 300 and the flash suppressor 100.

In this manner, the flash suppressor assembly 400 may be used as an integrated mount for a firearm sound suppressor. The collar 200 of the flash suppressor assembly 400 can be rotated to a closed position so that back pressure from the firearm sound suppressor will not cause propellant gases to travel backwards and exit through the interrupted threads, the air channels 110, and the air channel inlets 120.

When installed, the collar 200 and ring are positioned behind the flash suppressor 100 and are retained by the flash suppressor 100, which is threaded the attached or coupled to the muzzle.

Figure 29:
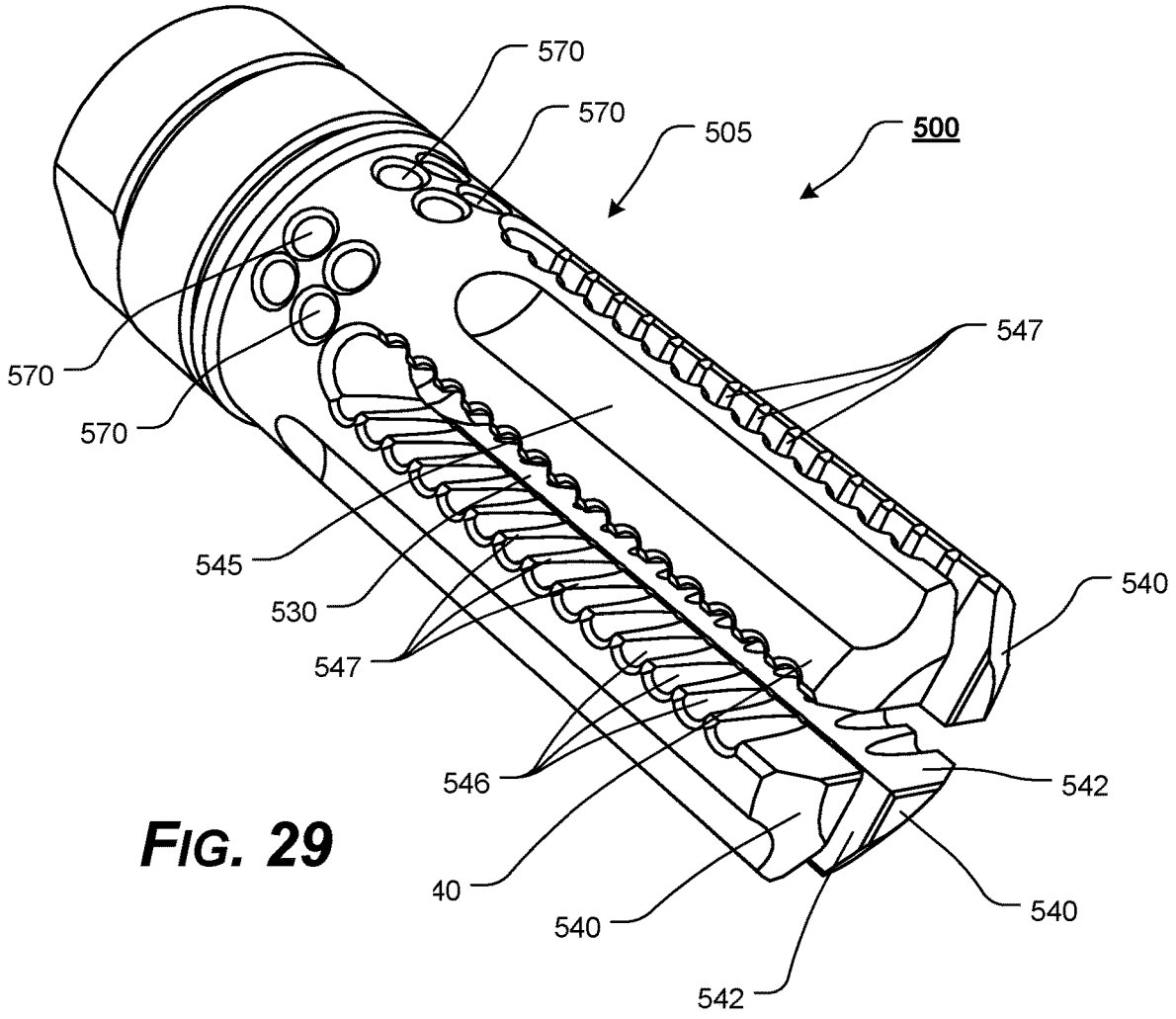
FIG. 29 shows a front perspective view of an exemplary embodiment of a flash suppressor, according to the present disclosure.
Figure 30:
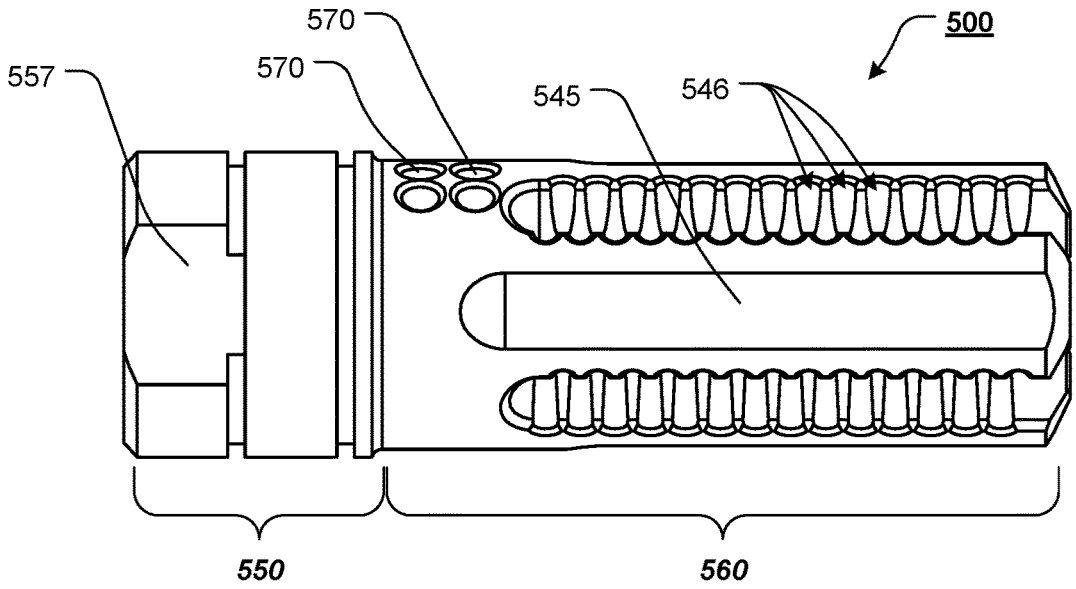
FIG. 30 shows a left side view of an exemplary embodiment of a flash suppressor, according to the present disclosure.
Figure 31:
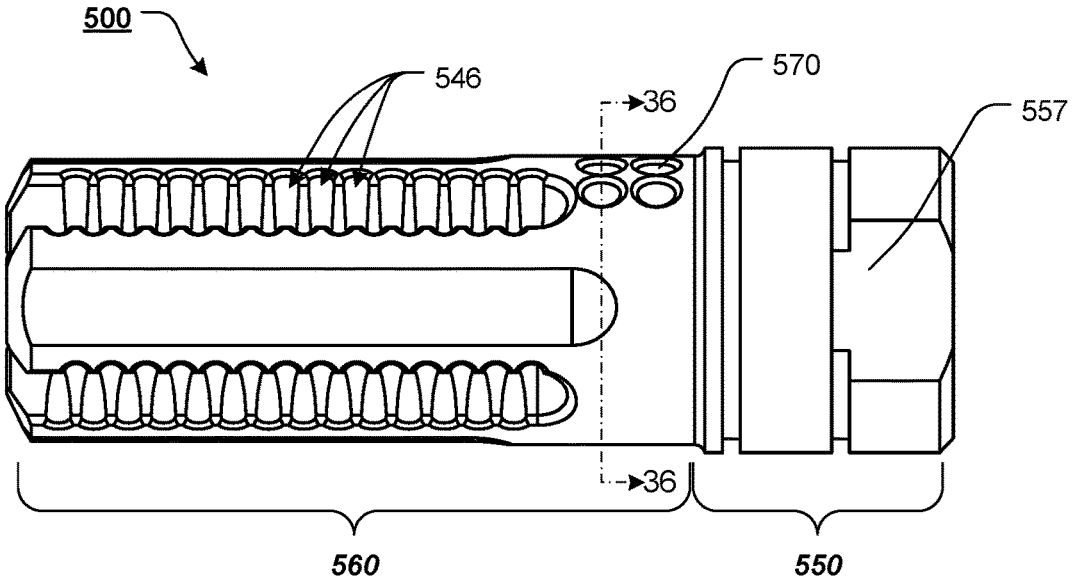
FIG. 31 shows a right side view of an exemplary embodiment of a flash suppressor, according to the present disclosure.
Figure 32:
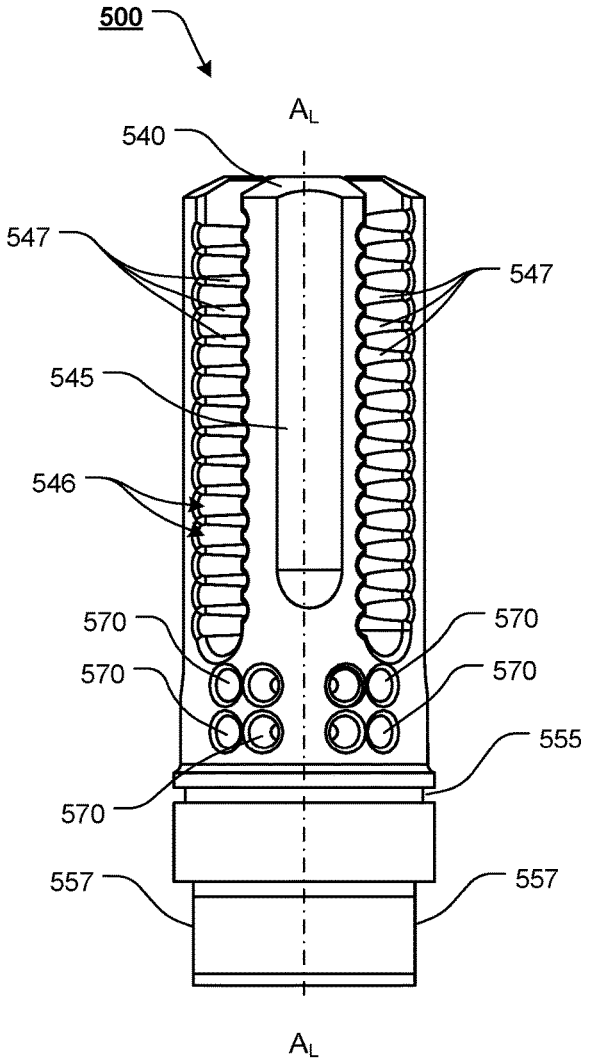
FIG. 32 shows a top view of an exemplary embodiment of a flash suppressor, according to the present disclosure.
Figure 33:
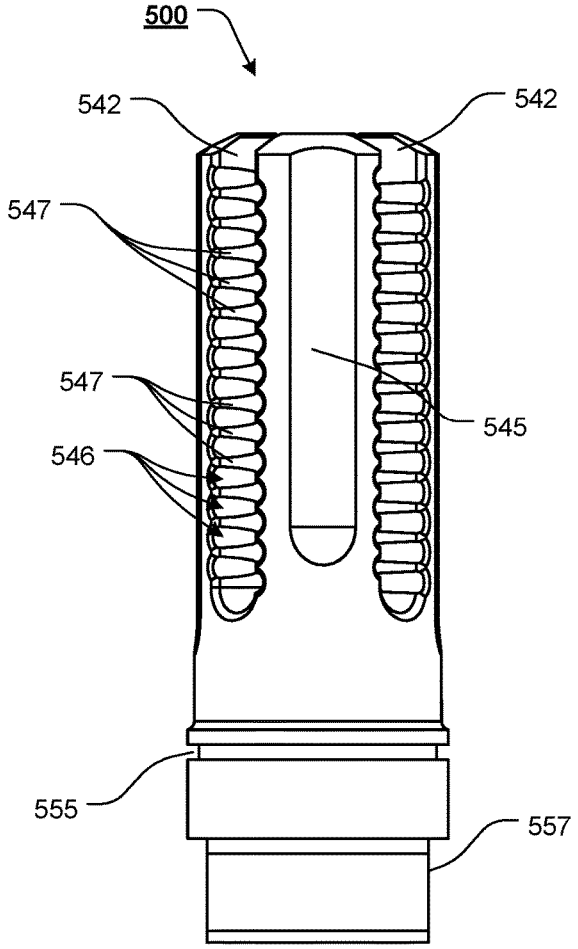
FIG. 33 shows a bottom view of an exemplary embodiment of a flash suppressor, according to the present disclosure.
Figure 34:
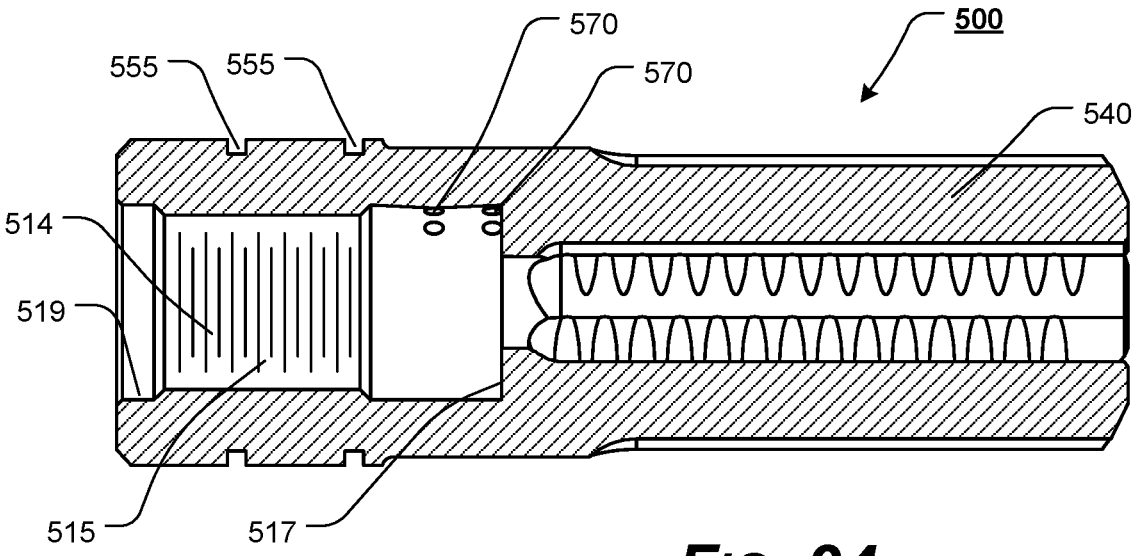
FIG. 34 shows a side cross-sectional view of a flash suppressor, taken along line 34-34 of FIG. 35.
Figure 35:
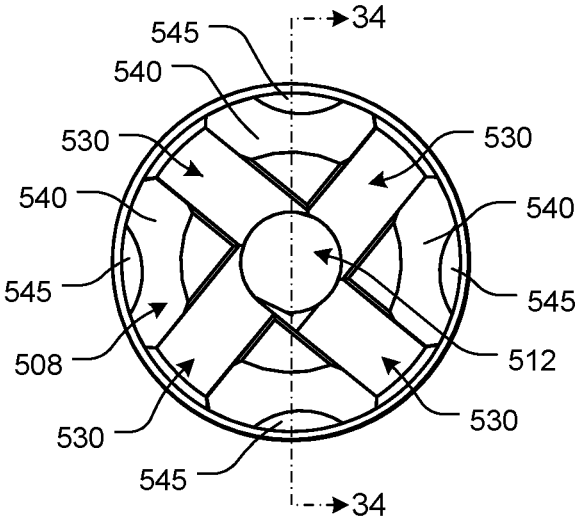
FIG. 35 shows a front view of an exemplary embodiment of a flash suppressor, according to the present disclosure.
Figure 36:
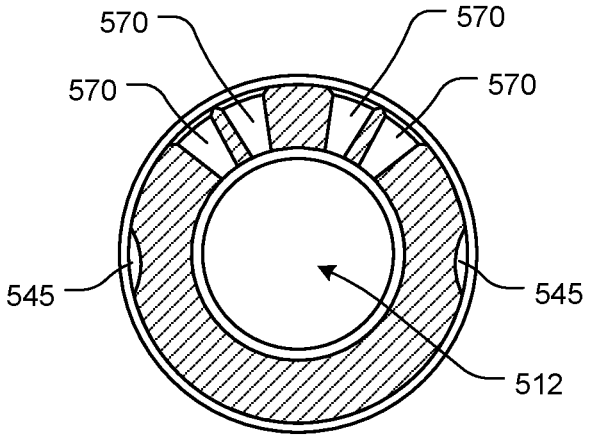
FIG. 36 shows a side cross-sectional view of a flash suppressor, taken along line 36-36 of FIG. 31.

FIGS. 29-36 illustrate certain elements, components, and/or aspects of a flash suppressor 500, according to the present disclosure. As illustrated, the flash suppressor 500 extends along a longitudinal axis $A_L$ from a first end 507 to a second end 508 and includes at least some of a flash suppressor body or body portion 505 that extends from an attachment portion 550 to a suppressor portion 560, a central borehole 512, an internally threaded attachment recess 514, mounting threads 515, a recess shoulder 517, a recessed portion 519, longitudinally extending slots 530 that form or define side walls 542 of forwardly extending elongated members or prongs 540, an external trough 545, a plurality of spaced apart relief cuts 546, a plurality of extending teeth 547, one or more optional, partially-circumferentially or circumferential attachment grooves 555, and optional parallel flats 557.

It should be understood that each of these elements corresponds to and operates similarly to the first end 107, the second end 108, the flash suppressor body or body portion 105, the attachment portion 150, the suppressor portion 160, the central borehole 112, the internally threaded attachment recess 114, the recess shoulder 117, the recessed portion 119, the longitudinally extending slots 130, the side walls 142, the forwardly extending elongated members or prongs 140, the external trough 145, the plurality of spaced apart relief cuts 146, the plurality of extending teeth 147, the one or more optional, partially-circumferentially or circumferential attachment grooves 155, and the optional parallel flats 157, as described above with reference to the flash suppressor 100 of FIGS. 1-28.

However, as illustrated in FIGS. 29-36, the mounting threads 515 extend in an uninterrupted fashion through at least a portion of the internally threaded attachment recess 514.

The relief cuts 546 are cylindrical relief cuts and are formed at approximately 7° to the surface of the prong 540 on the left hand side of the side walls 542 and cut all the way through the surface including the edge of the side walls 542 that faces the central borehole 512. The relief cuts 546 on the other surface of the side walls 542 are also at 7°, but do not cut all the way through the face of the prong 540.

The angle at which the cylindrical relief cuts 546 are formed causes a taper. The plurality of extending teeth 147 are offset from one side of the slots 530 to the other or on opposing sides of each slot 530. The relief cuts 546 are cylindrical and non-continuous. The relief cuts 546 are broken up by the edge of each respective prong 540 and separated by the straight line formed at the edge formed by the edge of the side walls 542.

In various exemplary, nonlimiting embodiments, a chamfer is applied to the edge of the relief cuts 546. Optionally, a chamfer may also be applied to the edge of the prongs 540. Thus, it should be appreciated that the chamfer applied to the edge of the relief cuts 546 and/or the chamfer applied to the edge of the prongs 540 is optional and a design choice.

In various exemplary embodiments, the relief cuts 546 on each prong 540 are of different lengths to assist in countering the tuning fork ringing that flash suppressors can produce.

The flash suppressor 500 optionally includes a series of apertures or muzzle rise mitigation port apertures 570 drilled or otherwise formed with tapered or straight holes formed through a portion of the suppressor portion 560. In various exemplary embodiments, the mitigation port apertures 570 extend radially from the central borehole 512, toward the outer surface of the body portion 505. If the mitigation port apertures 570 are tapered, they may optionally be tapered outward as they extend from the central borehole 512 or may be tapered inward as they extend from the central borehole 512. Each of the mitigation port apertures provides fluid communication between at least a portion of the central borehole 512 and the exterior of the flash suppressor 500.

In certain exemplary, nonlimiting embodiments, the mitigation port apertures 570 are arranged in a triangular or square grid pattern in an upper portion of the suppressor portion 560, between the first end 507 and one or more of the longitudinally extending slots 530. The by incorporating a plurality of mitigation port apertures 570, instead of one large aperture on each side of the flash suppressor 500, the propellant gases exiting the central borehole 512 are disrupted as they exit through the mitigation port apertures 570 and into the environment surrounding the flash suppressor 500.

A chamfer cut may optionally be formed proximate an outer edge of the plurality of extending teeth 147. If included, the chamfer cut reduces the possibility of snagging and allows for a wider flow of propellant gases as the propellant gases exits the edge of the flash suppressor 500.

Figure 37:
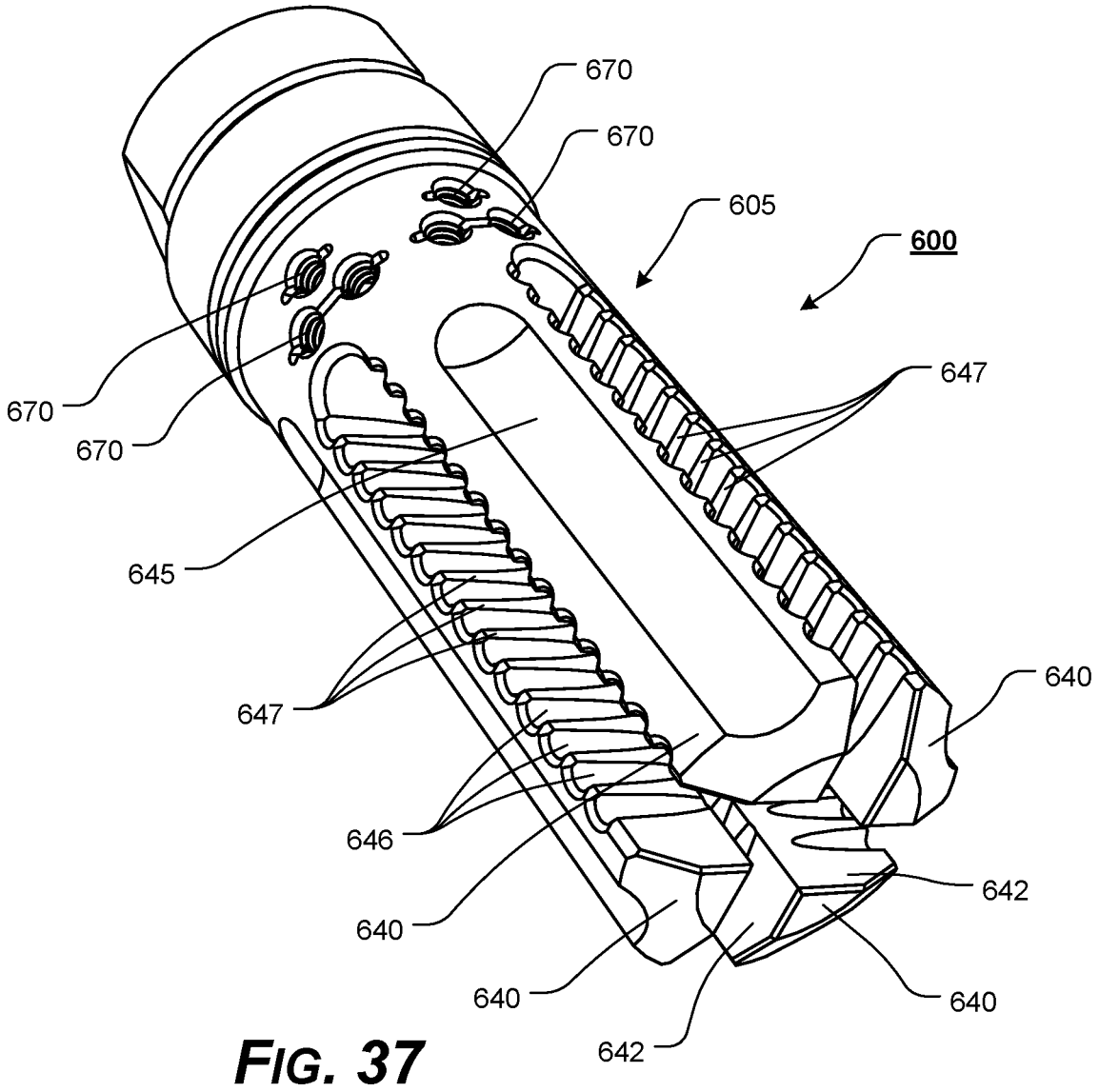
FIG. 37 shows a front perspective view of an exemplary embodiment of a flash suppressor, according to the present disclosure.
Figure 38:
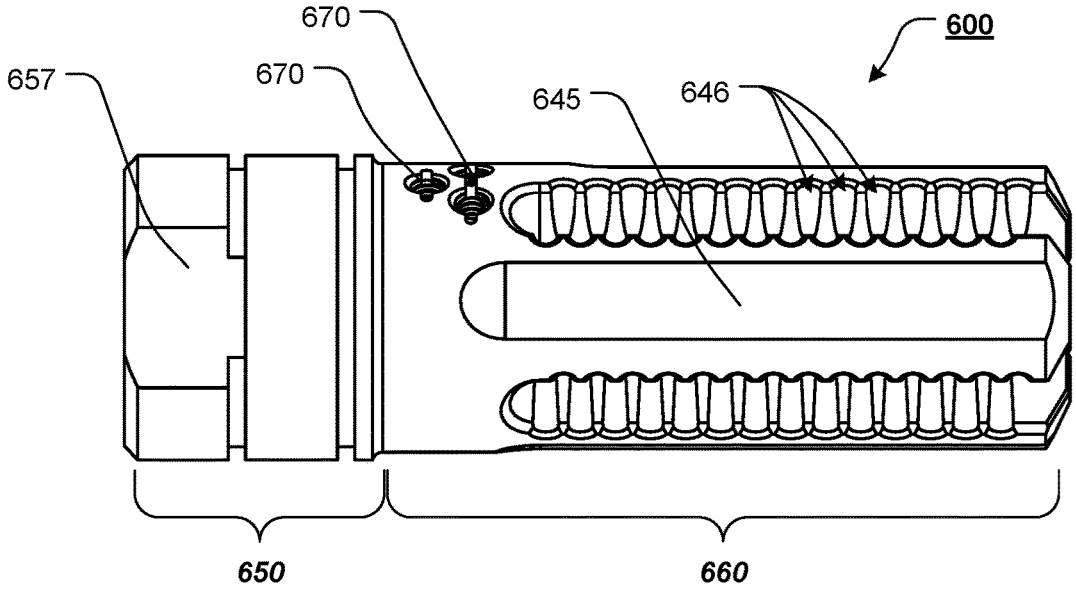
FIG. 38 shows a left side view of an exemplary embodiment of a flash suppressor, according to the present disclosure.
Figure 39:
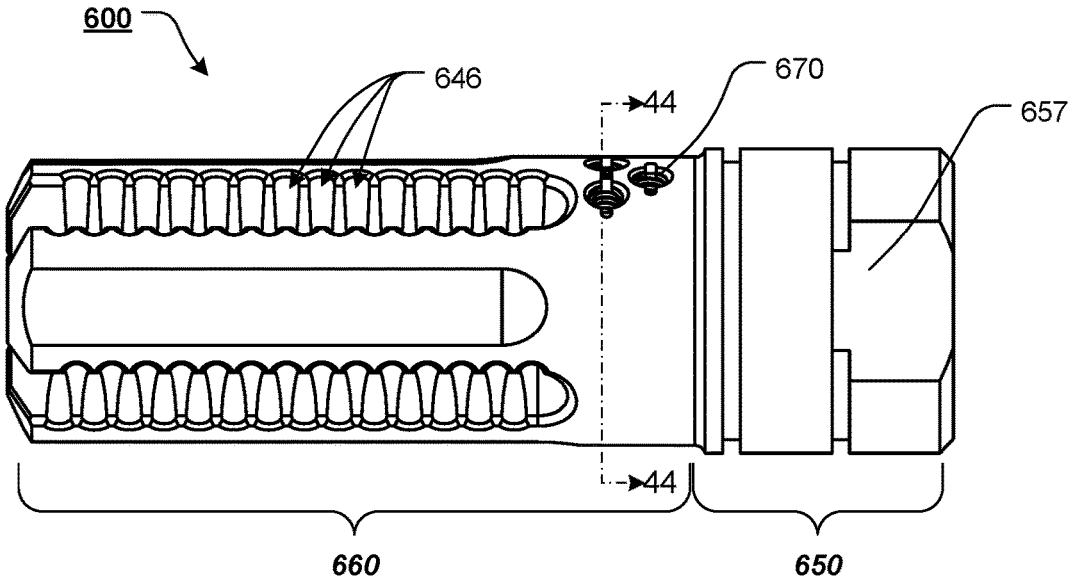
FIG. 39 shows a right side view of an exemplary embodiment of a flash suppressor, according to the present disclosure.
Figure 40:
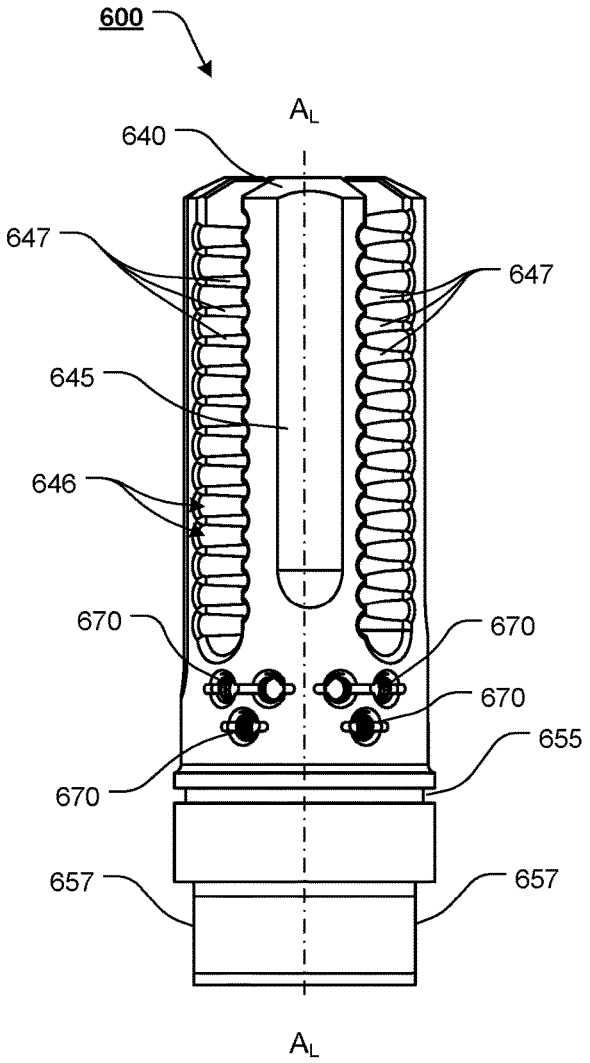
FIG. 40 shows a top view of an exemplary embodiment of a flash suppressor, according to the present disclosure.
Figure 41:
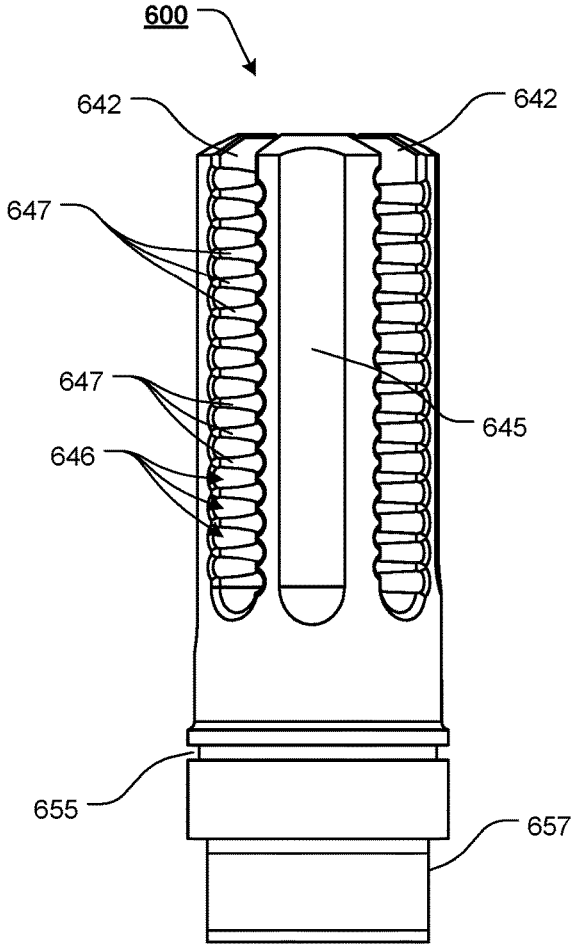
FIG. 41 shows a bottom view of an exemplary embodiment of a flash suppressor, according to the present disclosure.
Figure 42:
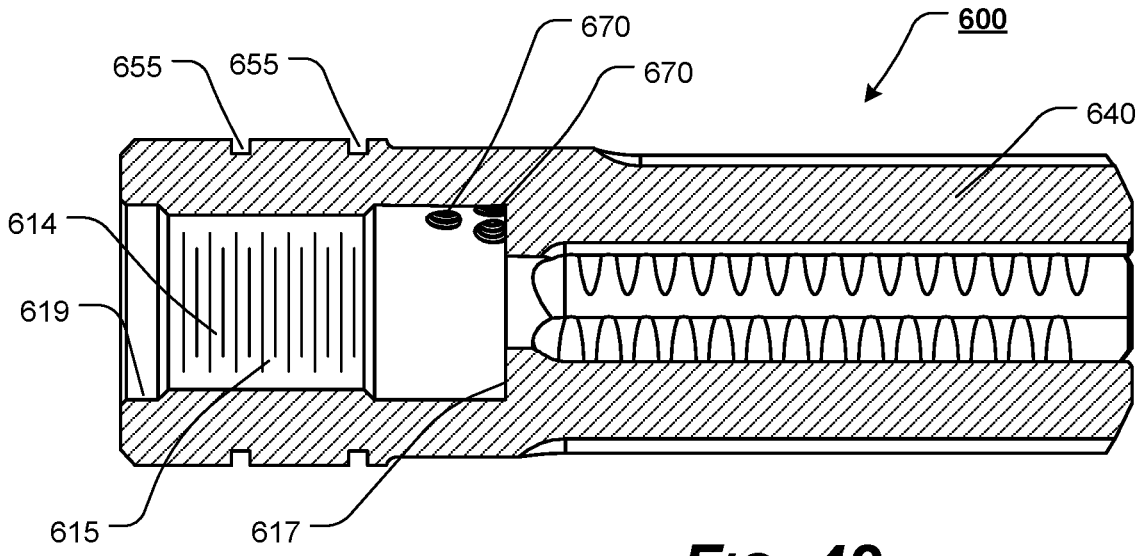
FIG. 42 shows a side cross-sectional view of a flash suppressor, taken along line 42-42 of FIG. 43.
Figure 43:
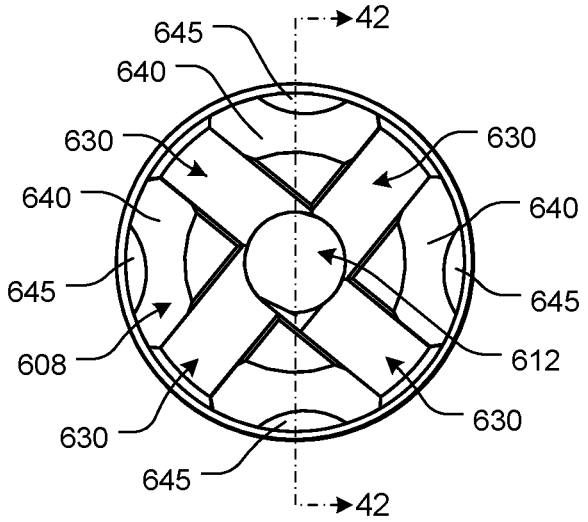
FIG. 43 shows a front view of an exemplary embodiment of a flash suppressor, according to the present disclosure.
Figure 44:
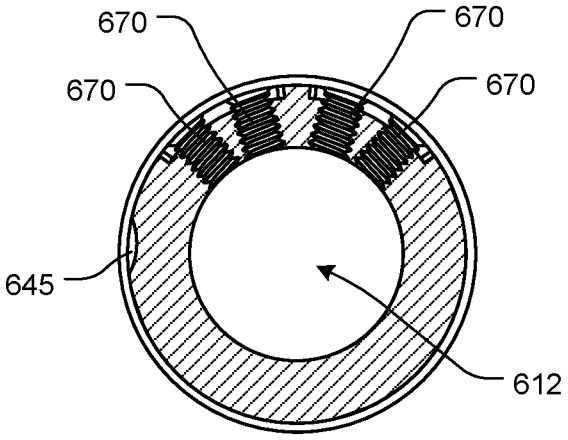
FIG. 44 shows a side cross-sectional view of a flash suppressor, taken along line 44-44 of FIG. 39.

FIGS. 37-44 illustrate certain elements, components, and/or aspects of a flash suppressor 600, according to the present disclosure. As illustrated, the flash suppressor 600 extends along a longitudinal axis $A_L$ from a first end 607 to a second end 608 and includes at least some of a flash suppressor body or body portion 605 that extends from an attachment portion 650 to a suppressor portion 660, a central borehole 612, an internally threaded attachment recess 614, mounting threads 615, a recess shoulder 617, a recessed portion 619, longitudinally extending slots 630 that form or define side walls 642 of forwardly extending elongated members or prongs 640, an external trough 645, a plurality of spaced apart relief cuts 646, a plurality of extending teeth 647, one or more optional, partially-circumferentially or circumferential attachment grooves 655, and optional parallel flats 657.

It should be understood that each of these elements corresponds to and operates similarly to the first end 507, the second end 508, the flash suppressor body or body portion 505, the attachment portion 550, the suppressor portion 560, the central borehole 512, the internally threaded attachment recess 514, the recess shoulder 517, the recessed portion 519, the longitudinally extending slots 530, the side walls 542, the forwardly extending elongated members or prongs 540, the external trough 545, the plurality of spaced apart relief cuts 546, the plurality of extending teeth 547, the one or more optional, partially-circumferentially or circumferential attachment grooves 555, and the optional parallel flats 557, as described above with reference to the flash suppressor 500 of FIGS. 29-36.

However, as illustrated in FIGS. 37-44, the mitigation port apertures 670 comprise threaded or at least partially threaded apertures. Alternatively, an inner portion of each mitigation port aperture 670 may be textured. By threading or texturing at least a portion of the mitigation port apertures 670, the mitigation port apertures 670 provide a rougher internal surface to further breakup or interrupt the flow of propellant gases as the propellant gases move through the mitigation port aperture 670.

The mitigation port apertures 670 may optionally be drilled or otherwise formed with tapered or straight holes formed through a portion of the suppressor portion 660. If the mitigation port apertures 670 are tapered, they may optionally be tapered outward as they extend from the central borehole 612 or may be tapered inward as they extend from the central borehole 612. Each of the mitigation port apertures provides fluid communication between at least a portion of the central borehole 612 and the exterior of the flash suppressor 600.

In various exemplary embodiments, the mitigation port aperture 670 include a chamfer where the mitigation port apertures transition to the outside surface of the body portion 605.

As illustrated, the mitigation port apertures 670 may optionally comprise horizontal or vertical cuts or recess is formed through at least a portion of the chamfer area. If included, these cuts or recesses causes propellant gases to escape in a non-uniform fashion and introduces turbulence to the flow of the escaping propellant gases, thus reducing flash further.

The inclusion of the mitigation port aperture 670 further act to counter muzzle rise of the firearm during a firing cycle.

It should also be appreciated that a more detailed explanation of the flash suppressors 100, 500, and/or 600 and flash suppressor assembly 400, instructions regarding the use and operation of the flash suppressors 100, 500, and/or 600 and/or flash suppressor assembly 400, and certain other items and/or techniques necessary for the implementation and/or operation of the flash suppressors 100, 500, and/or 600 and/or flash suppressor assembly 400 are not provided herein because such background information will be known to one of ordinary skill in the art.

While the present disclosure has been described in conjunction with the exemplary embodiments outlined above, the foregoing description of exemplary embodiments of the disclosure, as set forth above, are intended to be illustrative, not limiting and the disclosure should not be considered to be necessarily so constrained. It is evident that the disclosure is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the disclosure. The upper and lower limits of these smaller ranges may independently be included in the smaller ranges and is also encompassed within the disclosure, subject to any specifically excluded limit in the stated range. Where the stated range includes one or both of the limits, ranges excluding either or both of those included limits are also included in the disclosure.

It is to be understood that the phraseology of terminology employed herein is for the purpose of description and not of limitation. Unless defined otherwise, all technical and scientific terms used herein have the same meaning as commonly understood by one of ordinary skill in the art to which the present disclosure belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the disclosure, such that others may, by applying current knowledge, change, vary, modify, and/or adapt these exemplary, non-limiting embodiments for various applications without departing from the spirit and scope of the disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the disclosure.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A muzzle device, comprising:

a body portion extending from an attachment portion to a suppressor portion;

a central borehole extending through said body portion;

an internally threaded attachment recess extending from a first end of said body portion, along said central borehole;

one or more longitudinally extending slots defining side walls of elongate prongs;

a plurality of spaced apart relief cuts formed between an outer surface of said body portion and said side wall of each prong, wherein each of said plurality of relief cuts is formed through only a portion of said side wall of each prong; and a plurality of mitigation port apertures formed through a portion of said suppressor portion, wherein each of said mitigation port apertures is formed in an upper portion of said suppressor portion, between said first end and at least one of said one or more longitudinally extending slots, and wherein each mitigation port aperture provides fluid communication between at least a portion of said central borehole and an exterior of said body portion.

2. The muzzle device assembly of claim 1, wherein said body portion comprises an elongate portion of substantially cylindrical, oval, oblong, triangular, square, rectangular hexagonal, or octagonal material.

3. The muzzle device assembly of claim 1, wherein said attachment portion is adapted to attach to a muzzle end of a firearm barrel.

4. The muzzle device assembly of claim 1, wherein each prong is offset from each adjacent prong by one of said longitudinally extending slots.

5. The muzzle device assembly of claim 1, wherein each prong is separated from each adjacent prong by one of said longitudinally extending slots.

6. The muzzle device assembly of claim 1, wherein a width of each slot is at least partially tapered.

7. The muzzle device assembly of claim 1, wherein an extending tooth is formed between each adjacent relief cut.

8. The muzzle device assembly of claim 1, wherein said relief cuts on each prong are of different lengths.

9. The muzzle device assembly of claim 1, wherein each mitigation port aperture is tapered outward as it extends from said central borehole.

10. The muzzle device assembly of claim 1, wherein each mitigation port aperture is tapered inward as it extends from said central borehole.

11. The muzzle device assembly of claim 1, wherein said mitigation port apertures are arranged in a triangular or square grid pattern.

12. The muzzle device assembly of claim 1, wherein each mitigation port aperture comprises an at least partially threaded aperture.

13. A muzzle device, comprising:

a flash suppressor, wherein said flash suppressor comprises a body having a central bore aperture, wherein said flash suppressor comprises a plurality of prongs defined between a plurality of slots, wherein a plurality of relief cuts are disposed or formed through at least a portion of an outer surface of said body and side through at least a portion of a side wall of each prong, and wherein each of said plurality of relief cuts is formed through only a portion of said side wall of each prong; and a plurality of mitigation port apertures formed through a portion of said suppressor portion, wherein each of said mitigation port apertures is formed in an upper portion of said suppressor portion, between said first end and at least one of said one or more longitudinally extending slots, and wherein each mitigation port aperture provides fluid communication between at least a portion of said central borehole and an exterior of said body portion.

14. The muzzle device assembly of claim 13, wherein a width of each slot is at least partially tapered.

15. The muzzle device assembly of claim 13, wherein each of said plurality of relief cuts is spaced apart from each adjacent relief cut and wherein an extending tooth is formed between each adjacent relief cut.

* * * * *